US008771159B2

(12) United States Patent
Imazu et al.

(10) Patent No.: US 8,771,159 B2
(45) Date of Patent: Jul. 8, 2014

(54) SHEET FOLDING APPARATUS

(75) Inventors: Hiroki Imazu, Kofu (JP); Shinichi Ito, Kofu (JP); Mizuho Shirakura, Fuefuki (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 683 days.

(21) Appl. No.: 12/929,850

(22) Filed: Feb. 22, 2011

(65) Prior Publication Data

US 2011/0212817 A1 Sep. 1, 2011

(30) Foreign Application Priority Data

Feb. 26, 2010 (JP) ..... 2010-043495

(51) Int. Cl.
*B65H 45/14* (2006.01)

(52) U.S. Cl.
CPC ..... *B65H 45/147* (2013.01); *B65H 45/148* (2013.01)
USPC ..... 493/320; 270/20.1; 270/39.01; 493/420; 493/421; 493/435; 493/442

(58) Field of Classification Search
CPC .... B65H 45/14; B65H 45/142; B65H 45/144; B65H 45/145; B65H 45/147; B65H 45/148
USPC ..... 493/320, 405, 416, 419, 420, 421, 424, 493/434, 435, 436, 442, 443, 445, 454; 270/20.1, 39.01
IPC ..... B65H 45/14
See application file for complete search history.

(56) References Cited

U.S. PATENT DOCUMENTS

| | | | | | |
|---|---|---|---|---|---|
| 5,054,757 | A * | 10/1991 | Martin et al. | ..... | 493/420 |
| 5,263,708 | A * | 11/1993 | Hacknauer | ..... | 493/421 |
| 5,980,443 | A * | 11/1999 | Kayser et al. | ..... | 493/420 |
| 6,719,680 | B2 * | 4/2004 | Hosoya et al. | ..... | 493/424 |
| 8,256,757 | B2 * | 9/2012 | Imazu et al. | ..... | 493/416 |
| 8,529,423 | B2 * | 9/2013 | Imazu et al. | ..... | 493/434 |
| 2011/0101591 | A1 * | 5/2011 | Sano et al. | ..... | 270/20.1 |
| 2011/0103866 | A1 * | 5/2011 | Imazu et al. | ..... | 493/454 |
| 2012/0004086 | A1 * | 1/2012 | Shirakura et al. | ..... | 493/454 |

FOREIGN PATENT DOCUMENTS

| | | | | |
|---|---|---|---|---|
| JP | 2004-238201 | | 8/2004 | |
| JP | 2005008333 | A * | 1/2005 | ..... B65H 45/14 |
| JP | 2009-018494 | | 1/2009 | |

* cited by examiner

*Primary Examiner* — Stephen F Gerrity
(74) *Attorney, Agent, or Firm* — Manabu Kanesaka

(57) ABSTRACT

A sheet folding apparatus for folding a sheet, includes a first transport path for guiding the sheet from a carry-in portion to a carrying-out portion without folding; a second transport path branching off from the first transport path for folding the sheet; folding rollers to fold the sheet; a driving motor; and a control device for controlling the driving motor. The folding rollers are disposed in between the carry-in roller and the carrying-out roller. The first transport path has a pinch roller and a guide cover for covering the folding. The guide cover shifts between an actuation position in which the sheet does not contact the folding rollers and a non-actuation position in which the sheet engages with the folding rollers. The control device controls the guide cover to shift to the actuation position with the pinch roller separated from a periphery of the one of the rollers.

7 Claims, 17 Drawing Sheets

SHEET FOLDING APPARATUS

RELATED APPLICATIONS

The present application claims priority from Japanese Patent Application No. 2010-043495 filed Feb. 26, 2010 incorporated herein by reference.

BACKGROUND OF THE INVENTION

1. Technical Field

The present invention relates to a sheet folding apparatus for folding a sheet with an image formed thereon, and more particularly, to improve the transport mechanism for selectively performing folding processing on a sheet in a transport path for carrying the sheet from a carry-in portion to a carrying-out portion.

2. Description of the Related Art

Generally, this type of sheet folding apparatus has been known as an apparatus for folding a sheet with an image formed thereon by an image formation apparatus such as a printing press, printer apparatus and copier in a predetermined fold position to perform finish processing. For example, Japanese Patent Application Publication No. 2009-018494 proposes an apparatus which is coupled to a sheet discharge outlet of an image formation apparatus, folds a sheet with an image formed for filing, and carries the sheet out to subsequent binding processing.

The sheet folding apparatus for thus folding an image-formed sheet in half or one-third to carryout is configured as an independent apparatus as a post-processing apparatus of the image formation apparatus, or as a unit incorporated into the image formation apparatus or binding processing apparatus. Then, as a folding form, for example, for filing, various folding forms such as ½ folding, ⅓ Z-folding and ⅓ letter-folding are known corresponding to the intended use.

Then, the folding apparatus which is thus coupled to or incorporated into the image formation apparatus, binding apparatus (finisher apparatus, bookbinding apparatus) or the like requires a path (sheet discharge path) for carrying a sheet that is fed to a carry-in entrance (portion) out to a carrying-out exit (portion) without performing the folding processing on the sheet and another path (folding processing path) for carrying a sheet to the carrying-out exit after performing the folding processing on the sheet. Therefore, in Japanese Patent Application Publication No. 2009-018494, the sheet discharge path is provided between a carry-in entrance and carrying-out exit formed in an apparatus housing, the folding processing path is disposed below the sheet discharge path, a sheet without undergoing the folding processing is fed to the carrying-out exit from the sheet discharge path, and a sheet to undergo the folding processing is guided to the folding processing path and fed to the carrying-out exit after undergoing the folding processing.

Japanese Patent Gazette No. 4144496 discloses a sheet processing apparatus provided with a similar sheet discharge path and folding processing path. Then, in the folding processing path are disposed folding rollers for performing first folding on a sheet and folding rollers for performing second folding on the first-folded sheet, and the sheet from the carry-in entrance is folded in ½ or ⅓.

OBJECT OF THE INVENTION

As described above, in the conventional sheet folding apparatus, the folding processing path and folding mechanism are disposed on one side above or under with respect to the path (through path) direction for carrying a sheet from the carry-in entrance to the carrying-out exit without performing the folding processing. Accordingly, the problems have been known that the through path and the folding processing path are configured as in the shape of a T and thereby increase the size of the entire apparatus, and that the folding processing path becomes a complicated path configuration. For example, in the apparatuses in Japanese Patent Application Publication No. 2009-018494 and Japanese Patent Gazette No. 4144496, a sheet from the carry-in entrance is guided to a lower switchback path and undergoes the folding processing, a sheet discharge path is required which returns the folding-processed sheet again to the through path from the switchback path, and therefore, the path length of the folding processing path requires a length approximately two times longer than the sheet length.

Therefore, the inventor of the invention invented a path configuration having a through path (first transport path) for guiding a sheet from the carry-in entrance to the carrying-out exit without performing the folding processing, and a folding processing path (second transport path) for performing the folding processing on a sheet which branches off from the through path and is disposed in the direction to cross, and filed the patent application previously (Japanese Patent Application No. 2009-291375). By this means, the second transport path is split in two vertically via the first transport path, and making the apparatus small and compact is achieved.

When the second transport path is thus split in two above and below the first transport path, the folding mechanism disposed in the second transport path is situated close to the first transport path, and for example, the folding mechanism such as folding rollers is positioned in the cross portion of the first transport path and the second transport path. Therefore, part of the periphery of the folding roller of the second transport path is faced toward the first transport path to provide a sheet from the carry-in entrance with the transport force, and it is thereby possible to make the apparatus smaller and more compact.

However, when part of the folding roller disposed in the second transport path is disposed in the first transport path and is used also for sheet transport, the folding roller of the second transport path should be rotated in a transport mode for carrying a sheet without undergoing the folding processing from the carry-in entrance to the carrying-out exit, and problems such as the driving power and noise have newly arisen.

Therefore, the inventor of the invention conceived the idea of halting driving of the folding roller faced toward the first transport path to perform energy-saving operation in the transport mode for carrying a sheet without undergoing the folding processing from the carry-in entrance to the carrying-out exit, and concurrently with the idea, resolved the problem that the sheet front end fed to the carry-in entrance strikes the periphery of the halted folding roller and jams.

It is an object of the invention to provide a sheet folding processing apparatus for reducing a power consumption amount of the apparatus for selectively performing folding processing in carrying a sheet from a carry-in portion to a carrying-out portion, and concurrently therewith, making paper jams fewer.

Further, it is another object of the invention to provide a small and compact folding processing apparatus in simplified structure, where the apparatus is provided with a transport path for guiding a sheet from the carry-in portion to the carrying-out portion without performing the folding processing and a folding processing path for performing the folding processing on a sheet from the carry-in portion to guide to the carrying-out portion.

BRIEF SUMMARY OF THE INVENTION

To attain the aforementioned objects, in the invention, provided are a first transport path for guiding a sheet from the carry-in portion to the carrying-out portion without performing the folding processing, and a second transport path branching off from the first transport path and being disposed in a direction to cross, for performing the folding processing on a sheet from the carry-in portion to guide to the carrying-out portion, and a folding roller disposed in the second transport path is arranged so that at least part of the periphery faces the first transport path. Then, the invention is characterized in that a guide cover for covering the periphery of the roller is disposed in the first transport path to be able to shift to positions between an actuation position for covering so that the sheet does not contact the periphery of the roller and a non-actuation position in which the sheet engages with the periphery of the roller, and that the guide cover is controlled to shift to the actuation position with a pinch roller, which comes into press-contact and separates with/from the folding roller, separated from the periphery of the roller.

Further, the configuration will be described specifically. The configuration is provided with a first transport path 32 for guiding a sheet from a carry-in portion to a carrying-out portion without performing, folding processing, a second transport path 33 branching off from the first transport path and being disposed in a direction to cross, for performing the folding processing on a sheet from the carry-in portion 30 to guide to the carrying-out portion, a carry-in roller 40 disposed in the carry-in portion of the first transport path, a carrying-out roller 62*a* disposed in the carrying-out portion of the first transport path, folding rollers 41*b*, 49, 50 disposed in folding positions NP1, NP2 of the second transport path to fold the sheet, a driving motor MF for driving the carry-in roller, carrying-out roller and folding rollers, and control means 95 for controlling the driving motor.

Then, the folding roller 41*b* is disposed so that at least part of the periphery faces the first transport path in between the carry-in roller and the carrying-out roller, a pinch roller 41*a* capable of coming into press-contact and separating with/from the periphery of the folding roller is provided in the first transport path, the first transport path is further provided with a guide cover 44 for covering the periphery of the folding roller facing the first transport path, and the guide cover is configured to be able to shift to positions between an actuation position for covering so that the sheet that is carried in the first transport path does not contact the periphery of the folding roller and a non-actuation position in which the sheet engages with the periphery of the folding roller.

Then, the control means controls roller moving up/down means for bringing and separating the pinch roller into press-contact with/from the periphery of the roller, and guide shift means for shifting the guide cover to positions between the actuation position and the non-actuation position so as to shift the guide cover to the actuation position with the pinch roller separated from the periphery of the roller.

In the invention, the folding roller of the second transport path for performing the folding processing on a sheet is disposed so that at least part of the periphery faces the first transport path for carrying out a sheet without performing the folding processing, the guide cover for covering the periphery of the roller is disposed to be able to shift to positions between the actuation position for covering so that the sheet does not contact the periphery of the roller and the non-actuation position in which the sheet engages with the periphery of the roller, it is configured that the guide cover shifts to the actuation position with the pinch roller, which comes into press-contact and separates with/from the folding roller, separated from the periphery of the roller, and therefore, the following effect is produced.

The folding roller disposed so that part of the periphery faces the first transport path is made a driving halt state in carrying out a sheet without performing the folding processing, while providing the sheet from the carry-in portion with the transport force in performing the folding processing, it is thereby possible to simplify the sheet transport mechanism disposed in the first transport path, and therefore, it is possible to reduce the power consumption amount of the apparatus, and concurrently therewith, provide the apparatus with few sheet jams.

Thus, in the invention, the periphery of the folding roller is faced toward the first transport path to provide a sheet from the carry-in portion with the transport force, and it is thereby possible to simplify the sheet transport mechanism disposed in the first transport path. Further, the guide cover 44 covers so that the sheet does not contact the periphery of the folding roller, and it is thereby possible to reduce the power consumption amount of the apparatus when the sheet without undergoing the folding processing is shifted to the carrying-out portion with the folding roller halted. Concurrently therewith, the periphery of the folding roller is covered with the guide cover, and therefore, the sheet front end does not strike the periphery of the halted roller, and thus, does not result in a transport failure.

Further, in the non-actuation position, in which the sheet engages with the periphery of the folding roller, of the guide cover for guiding the periphery of the roller, the sheet from the carry-in portion is disposed in the position for guiding to a nip portion between the periphery of the roller and the pinch roller, and it is thereby possible to prevent the sheet front end being folded (edge-folded) in providing the sheet with the transport force by the folding roller.

DETAILED DESCRIPTION OF THE INVENTION

Figure 1:
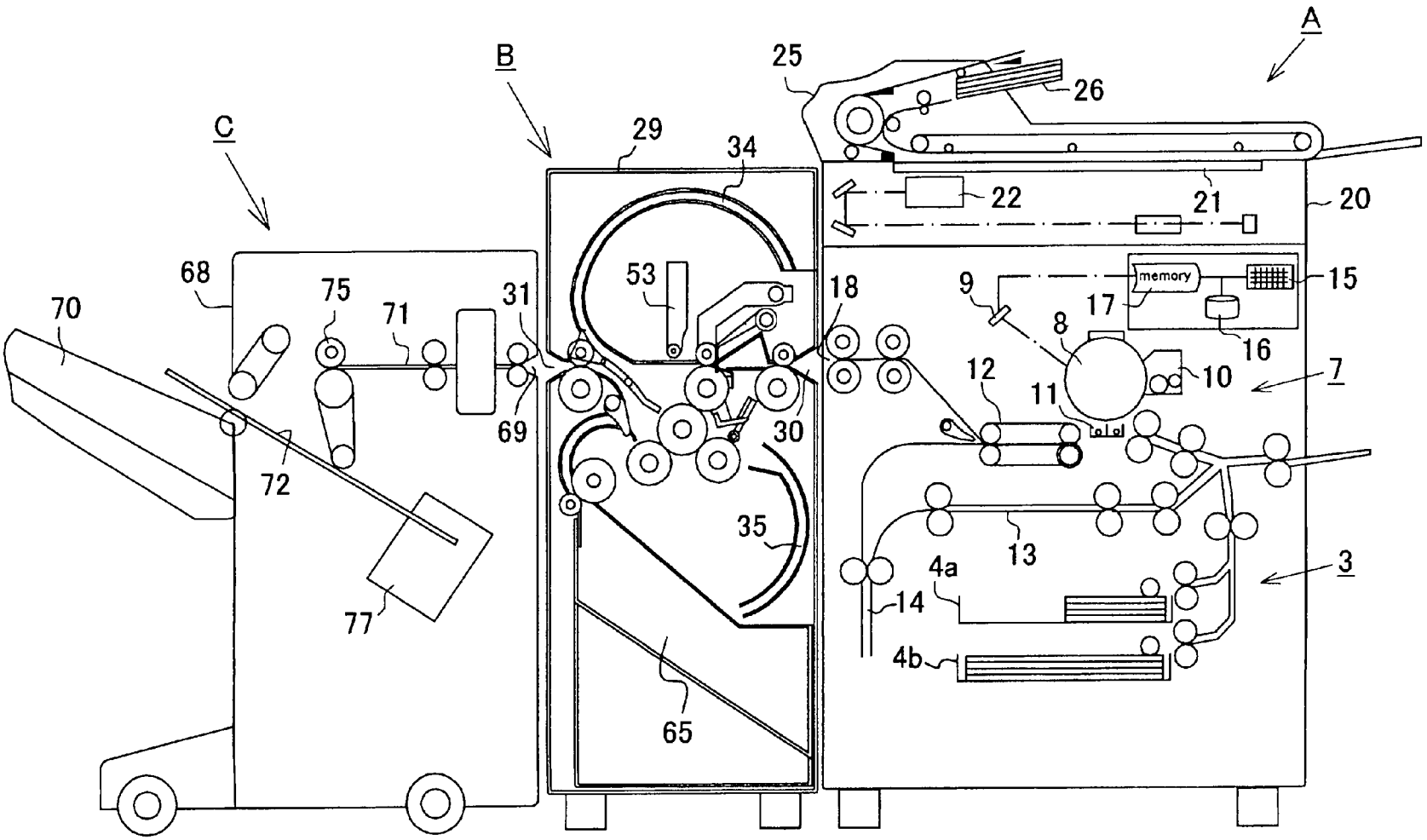
FIG. 1 is an explanatory view of an entire configuration of an image formation system provided with a sheet folding apparatus according to the invention.

The invention will specifically be described below based on Embodiments shown in the figures. FIG. 1 shows an image formation system provided with a sheet folding apparatus according to the invention. This system is comprised of an image formation apparatus A and a post-processing apparatus C, and the post-processing apparatus C is installed with a sheet folding apparatus B as a unit.

The image formation apparatus A is configured as a printer, copier, printing press or the like for sequentially forming images on sheets. The apparatus as shown in the figure is comprised of an image formation section 7, original document reading section 20 and feeder section (original document feeding apparatus) 25 as a complex copying machine having the copier function and the printer function. Further, the post-processing apparatus C is coupled to a main-body sheet discharge outlet 18 of the image formation apparatus A, and is configured to perform post-processing such as folding processing, punching processing, sealing processing and binding processing on a sheet with an image formed. Then, the post-processing apparatus C is integrally provided with the sheet folding apparatus B for performing folding processing on a sheet with an image formed. The sheet folding apparatus B, image formation apparatus A and post-processing apparatus C will be described below in this order.

[Sheet Folding Apparatus]

The sheet folding apparatus B according to the invention is incorporated into the image formation apparatus A or the post-processing apparatus C, or is configured as an apparatus (stand-alone configuration) independent of the apparatuses. The apparatus as shown in the figure is disposed between the image formation apparatus A and the post-processing apparatus C as an optional unit.

Figure 3:
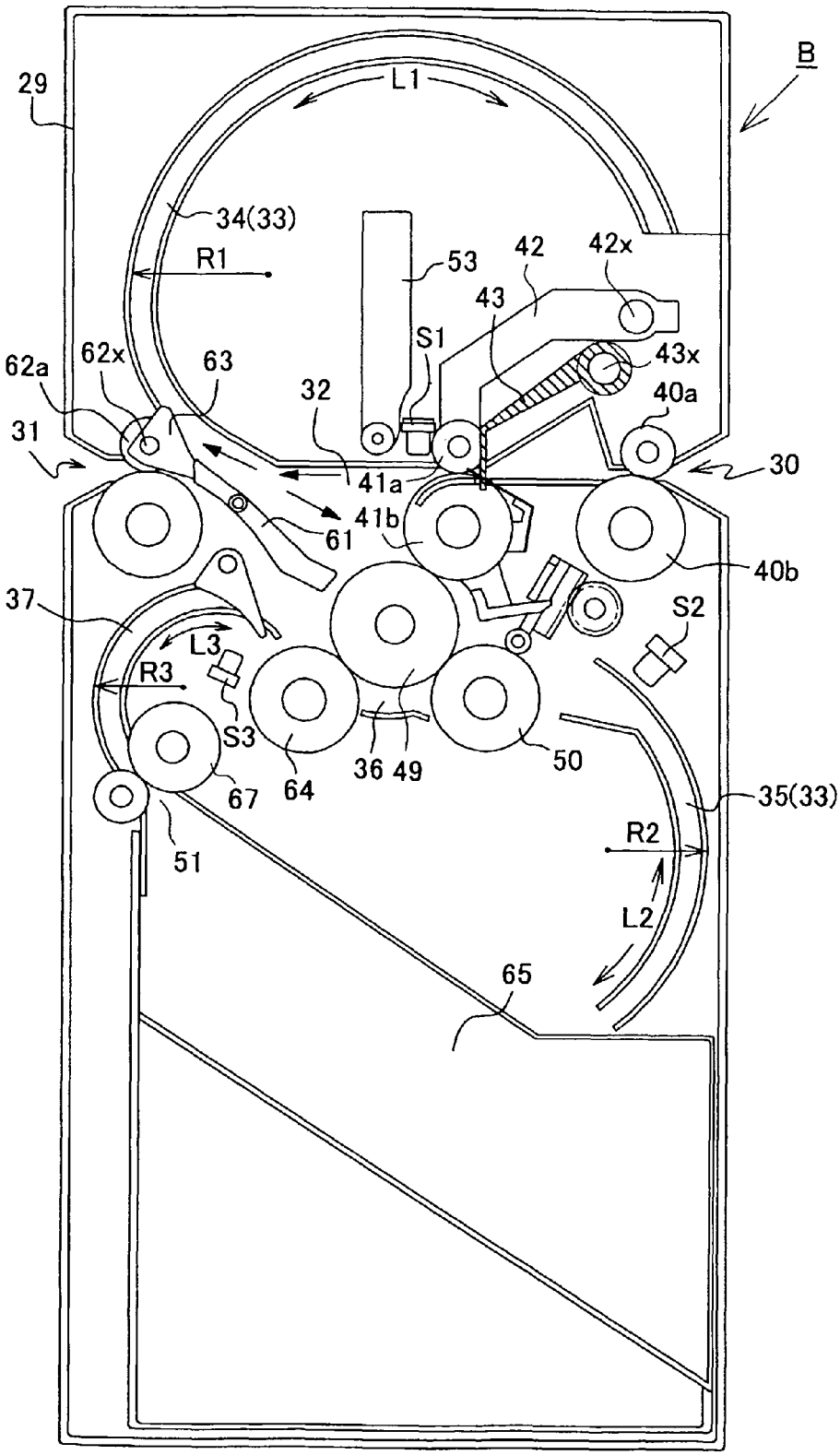
FIG. 3 is an explanatory view of an entire configuration of the sheet folding apparatus in the system of FIG. 1.

In the sheet folding apparatus B, as shown in FIG. 3 illustrating the entire configuration, an apparatus housing 29 is provided with a carry-in entrance 30 and a carrying-out exit 31, the carry-in entrance 30 is arranged in a position continued to the main-body sheet discharge outlet 18 of the image formation apparatus A on the upstream side, and the carrying-out exit 31 is arranged in a position continued to a sheet receiving opening 69 of the post-processing apparatus C on the downstream side. In addition, in the invention, there are cases that the sheet folding apparatus B is not provided with an independent apparatus housing 29, and for example, is incorporated into a casing of the post-processing apparatus C, and the cases do not require the carry-in entrance 30 and carrying-out exit 31. Accordingly, in the following description, the carry-in entrance 30 is synonymous with a carry-in portion, the carrying-out exit 31 is synonymous with a carrying-out portion, and for convenience in description, the description is given while assuming that the carry-in portion is the carry-in entrance 30 and that the carrying-out portion is the carrying-out exit 31.

As shown in FIG. 3, the carry-in entrance 30 and carrying-out exit 31 are disposed opposite each other across the apparatus housing 29. The carry-in entrance 30 and carrying-out exit 31 shown in the figure are disposed in opposite positions in the substantially horizontal direction. Then, in between the carry-in entrance 30 and the carrying-out exit 31 are disposed a first transport path 32 for carrying out a sheet from the carry-in entrance 30 to the carrying-out exit 31 without performing folding processing, and a second transport path 33 for performing the folding processing on a sheet from the carry-in entrance 30 to carry out to the carrying-out exit 31. A "sheet transport mechanism" for carrying a sheet in the predetermined direction (horizontal direction) is disposed in the first transport path 32, and a "folding processing mechanism" for performing the folding processing on a sheet is disposed in the second transport path 33.

[Path Configuration]

As shown in FIG. 3, in the apparatus housing 29, the first transport path (hereinafter, referred to as a "first path") 32 is disposed between the carry-in entrance 30 and the carrying-out exit 31. This path may be a linear path disposed in the horizontal direction as shown in the figure, may be configured as a curved path, or may be disposed in the vertical direction, and it is possible to adopt any configuration. As described above, the first path 32 guides a sheet from the carry-in entrance 30 to the carrying-out exit 31 without performing the folding processing.

Further, the second transport path (hereinafter, referred to as a "second path") 33 is configured as a path for performing the folding processing on a sheet from the carry-in entrance 30. Therefore, the second path 33 branches off from the first path 32 and is configured to guide a sheet from the carry-in entrance 30 to sheet folding positions Np1 and Np2. Concurrently therewith, as shown in FIG. 3, the second path 33 is disposed in a direction in which the path 33 crosses the first path 32, and the first folding position Np1 and the second folding position Np2 are set in this path. Then, the second path 33 is comprised of a first switchback path 34 for guiding the sheet front end for first folding to the first folding position Np1, and a second switchback path 35 for guiding the folded sheet front end to the second folding position Np2 to perform second folding on the folding-processed sheet.

Figure 4A:
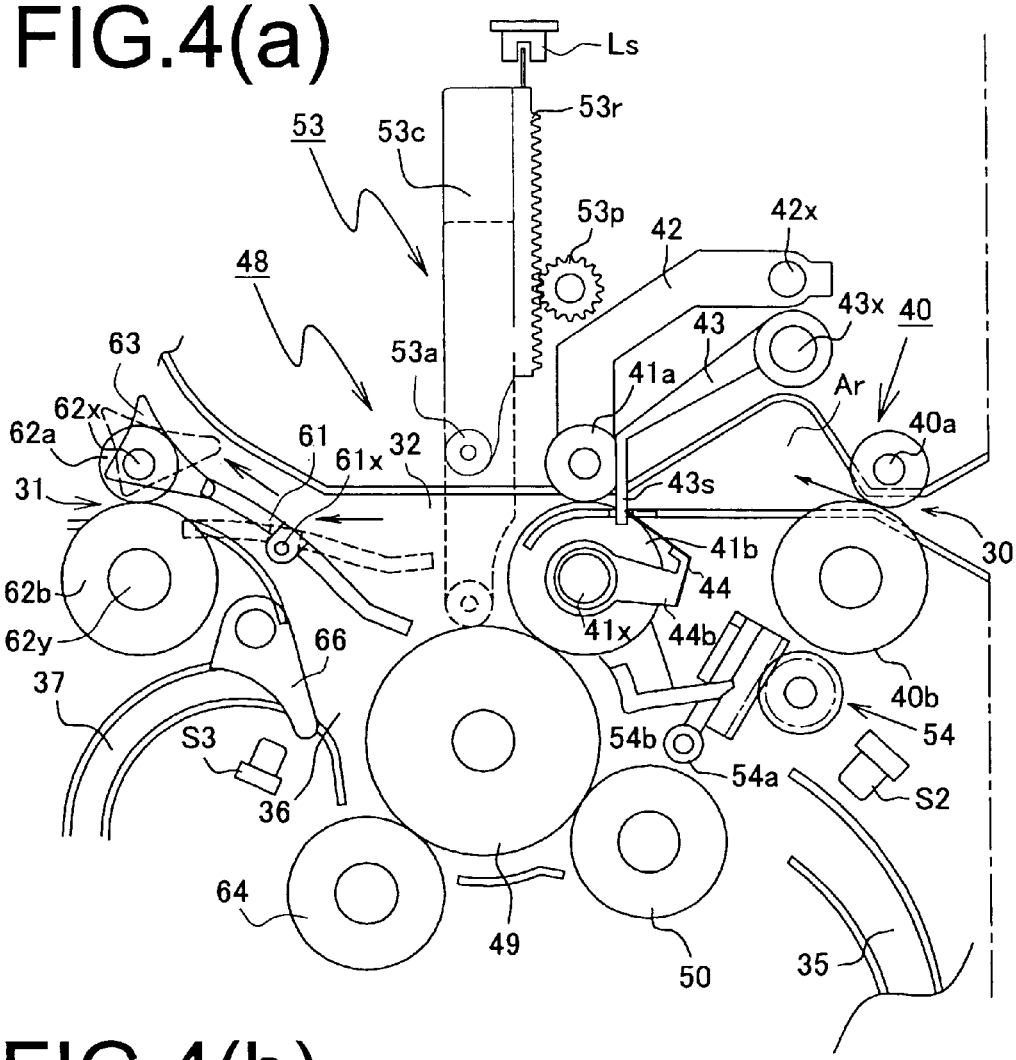
FIGS. 4(*a*)-4(*c*) contain enlarged explanatory views of principal part in the sheet folding apparatus of FIG. 3, where FIG. 4(*a*) shows the entire part, FIG. 4(*b*) shows a configuration of a carry-in portion, and FIG. 4(*c*) shows a press-contact state of a carry-in roller.

Thus, the second path 33 is disposed in the direction to cross the first path 32, where the first switchback path 34 is disposed in the area above the first path 32, the second switchback path 35 for carrying a sheet from the cross portion to the downstream side (the direction of the second folding position Np2) is disposed in the area below the first path 32, and the paths 34 and 35 are thus arranged to be opposed. Then, each of the first switchback path 34 and second switchback path 35 is comprised of a curved path and formed substantially in the shape of an S-curve as shown in FIG. 3. In the second path 33, folding processing means (folding roller mechanism) 48 (FIG. 4(*a*) described later is disposed in the first folding position Np1 and second folding position Np2, and the second path 33 is connected to a third transport path (hereinafter, referred to as a "third path") 36 for carrying out the folded sheet from the second folding position Np2 toward the carrying-out exit 31.

To addition, the first path 32 and the second path 33 are disposed to cross each other, and the first switchback path 34 for guiding the sheet to the first folding position Np1 may be disposed below the first path 32, while the second switchback path 35 for guiding the folding-processed sheet to the downstream side may be disposed above the first path 32. Further, in the Embodiment of FIG. 3, the first path 32 is disposed in the horizontal direction, and when the path 32 is disposed in the vertical direction in the apparatus housing 29, it is possible to arrange the first switchback path 34 and second switchback 35 to the left and right areas of the path 32 to be opposite each other.

Further, in the Embodiment as shown in FIG. 3, in relation to the second switchback path 35 guiding the folded sheet to the second folding position Np2 to perform second folding on the sheet, the path 35 is configured to reverse the feeding direction of the sheet, but when second folding is not performed on the sheet, the path 35 can be a path to extend straight.

The second path 33 is connected to the third path 36 for guiding the folding-processed sheet to the carrying-out exit 31. The third path 36 shown in the figure is provided in between the second folding position Np2 for performing second folding on the sheet and the carrying-out exit 31. In the third path 36 is disposed a sheet discharge path 37 for guiding the folded sheet to a storage stacker 65 from a sheet discharge outlet 51 different from the carrying-out exit 31.

The first switchback path 34 configured as described above as formed of a path curved in the shape of an arc having the curvature R1 as shown in FIG. 3, and the second switchback path 35 is formed of a path curved in the shape of an arc having the curvature R2 as shown in FIG. 3. Further, the sheet discharge path 37 continued to the third path 36 is formed of a path curved in the shape of an arc having the curvature R3.

Then, a path length L1 of the first switchback path 34 for guiding a sheet from the first path 32 to the first folding position (first nip portion) Np1 and a path length L2 of the second switchback path 35 for guiding the folded sheet subjected to first folding to the second folding position (second nip portion) Np2 are configured so that path length L1>path length L2.

A path length L3 of the sheet discharge path 37 for guiding the sheet further subjected to the folding processing to the storage stacker 65 from the second folding position Np2 is configured so that L3<L2<L1. This is because when the first folding position (first nip portion) Np1 is disposed near the first path 32, the path lengths are L3<L2<L1 as a result, and the path configuration is thereby made compact.

Thus, the first switchback path 34 with the longest path length is disposed above the first path 32, the second switchback path 35 with the short path length is disposed below the first path 32, the sheet discharge path 37 is similarly disposed below the first path 32, and the storage stacker 65 is disposed further below. Accordingly, the first switchback path 34 with the long path length is disposed in the upper area of the first path 32, the second switchback path 35 and the sheet discharge path 37 with the short path lengths are disposed in the lower area of the first path 32 opposite the upper area, and further, the storage stacker 65 is disposed below the second switchback path 35 and the sheet discharge path 37. By such a layout configuration, it is possible to make the inside space of the apparatus housing 29 compact.

[Path Switching Means]

Figure 4B:
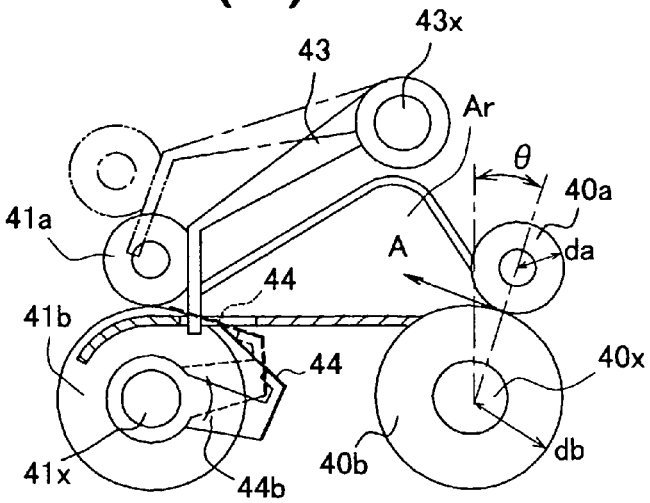
Figure 4C:
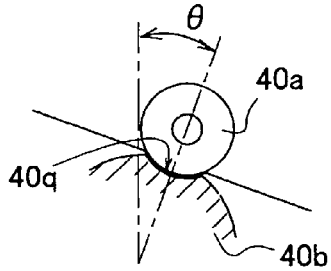

The following path switching means 63 is disposed in the cross portion of the above-mentioned first path 32 and second path 33. As described previously, the second path 33 branches off from the first path 32 and guides a sheet fed from the carry-in entrance 30 to the first and second folding positions Np1, Np2. Therefore, the path switching means 63 is disposed in the cross portion of the first and second paths 32 and 33. As shown in FIG. 4(*a*), a base end portion is axially supported by an apparatus frame (in the figure, spindle 62*x* of the carrying-out roller 62*a*) outside the path to be swingable.

Then, the path switching means 63 guides a sheet fed to the first path 32 to the first switchback path 34 of the second path 33 in the solid-line attitude in FIG. 4(*a*), while guiding a sheet fed to the first path 32 to the carrying-out exit 31 from the carrying-roller pair 62 in the dashed-line attitude in FIG. 4(*a*).

A sheet guide 61 is provided in the cross portion of the first path 32 and second path 33 together with the path switching means 63. The sheet guide 61 is disposed in between the first roller 41*b* and the carrying-out roller pair 62 in the first path 32, guides a sheet fed from the carry-in roller pair 40 to the second path 32, and concurrently therewith, guides a reversed sheet from the second path 33 (first switchback path 34) to the first folding position Np1. Further, the sheet guide 61 guides a sheet fed to the first path 32 to the carrying-out exit 31 from the carrying-out roller pair 62 without guiding the sheet to the second path 33.

Therefore, the sheet guide 61 is disposed in the cross portion with a relatively long transport span, and guides the sheet to the second path 33 side or carrying-out exit 31 side in cooperation with the path switching means 63 as described previously. In the apparatus as shown in the figure, as shown in FIG. 4(*a*), the guide 61 comprised of a guide plate supported swingably in the spindle 61*x* by the apparatus frame, and is configured to be able to shift to positions between a first guide attitude (solid line in FIG. 4(*a*)) for guiding a sheet from the path end portion (first switchback path 34) of the second path 33 to the first folding position Np1, and a second guide attitude (dashed line in FIG. 4(*a*)) for guiding a sheet from the carry-in roller pair 40 toward the carrying-out roller 62*a*.

Figure 7A:
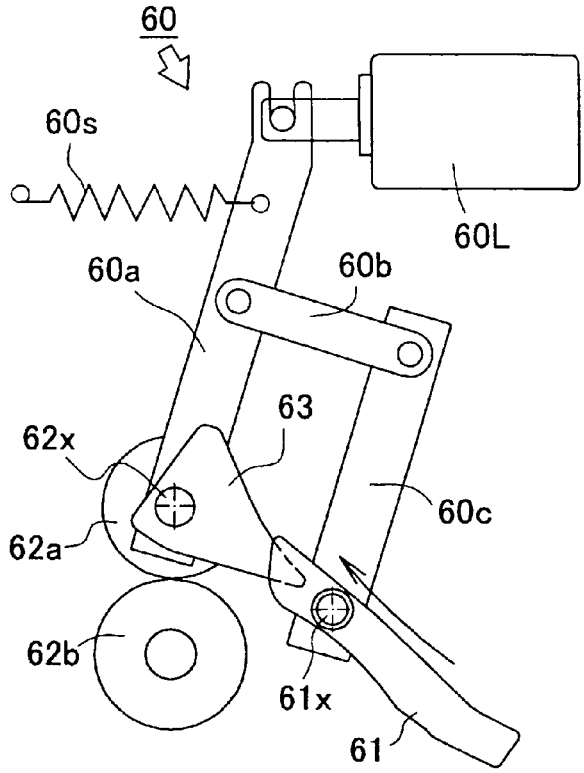
FIGS. 7(*a*), 7(*b*) contain explanatory views of a driving mechanism of path switching means in the apparatus of FIG. 3, where FIG. 7(*a*) shows a state in which a sheet is fed to a first switchback path, and FIG. 7(*b*) shows a state in which the sheet is fed to a sheet discharge outlet.
Figure 7B:
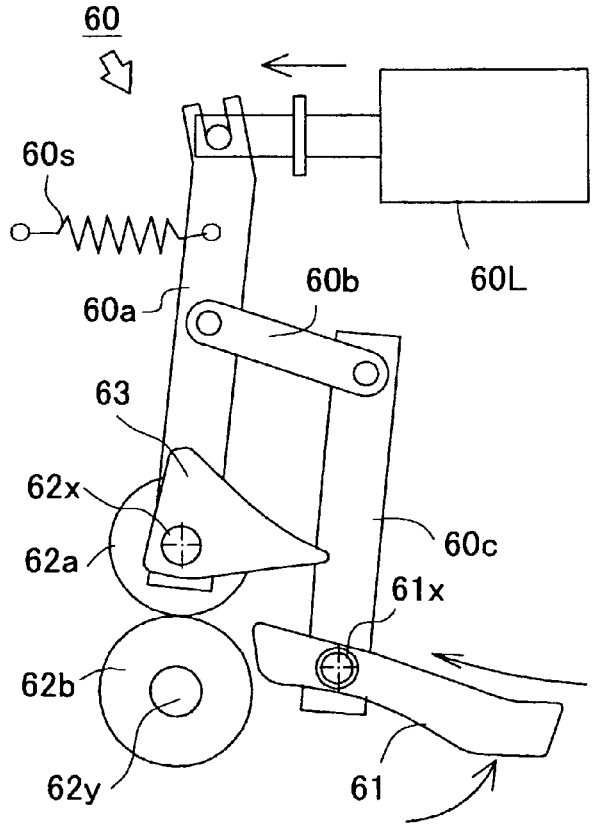

The attitude deflecting means 60 for deflecting the attitude of the sheet guide 61 between the first guide attitude and the second guide attitude is comprised of the same driving means, for example, as that of the path switching means 63 as described previously. FIGS. 7(*a*) and 7(*b*) show the mechanism, and the mechanism shown in the figure indicates the case where an electromagnetic solenoid 60L deflects the attitudes of the path switching means 63 and sheet guide 61. A first link lever 60*a* is axially supported swingably by the spindle 62*x* of the path switching means 63. The first link lever 60*a* and path switching means 63 are integrally combined. Then, the electromagnetic solenoid 60L is coupled to the front end portion of the first link lever 60*a*, and a return spring 60*s* is laid in the direction in which the path switching means 63 guides a sheet to the second path 33 side.

Meanwhile, a second link lever 60*c* is axially supported swingably by the spindle 61*x* in the sheet guide 61, and the second link lever and sheet guide 61 are combined to integrally rotate. Then, the first link lever 60*a* and second link lever 60*c* are coupled by an intermediate lever 60*b*. Accordingly, when the electromagnetic solenoid 60L is ON, as shown in FIG. 7(*a*), the first link lever 60*a* rotates a predetermined angle on the spindle 62*x* as the center, and positions the path switching means 63 in the first attitude (attitude for guiding a sheet to the second path 33). Further, in this state, the second link lever 60*c* rotates a predetermined angle on the spindle 61*x* as the center, and positions the sheet guide 61 in the first guide attitude (attitude for guiding a sheet to the second path 33).

Further, the electromagnetic solenoid 60L is turned OFF, as shown in FIG. 7(*b*), the first link lever 60*a* rotates in a counterclockwise direction shown in the figure on the spindle 62*x* as the center by action of the return spring 60*s*, and posit ions the path switching means 63 in the second attitude (attitude for guiding a sheet to the carrying-out exit 31). Concurrently, the second link lever 60*c* rotates in a counterclockwise direction on the spindle 61*x* as the center, and varies the sheet guide 61 to the second guide attitude (attitude for guiding a sheet to the carrying-out exit 31).

[Configuration of Folding Rollers]

In the second path 33 are disposed the first roller 41*b*, second roller 49 and third roller 50 to come into press-contact with one another. The first nip portion (first folding position) Np1 for first folding the sheet is formed in a press-contact point between the first roller 41*b* and second roller 49, and the second nip portion (second folding position) Np2 for second folding the sheet is formed in a press-contact point between the second roller 49 and the third roller 50.

Meanwhile, in the roller diameter of each of the first, second and third rollers, the second roller diameter is the maximum, and for example, 30 mm, the first and third roller diameters are 20 mm, and the second roller 49 positioned at the center is configured to have the maximum diameter (for example, 1.5 time). This is because of configuring the folding portion front end to be compact by arranging the first roller 41*b* and third roller 50 around the periphery of the second roller 49 in the shape of satellites. In other words, with respect to the second roller 49 with the maximum diameter, the first roller 41*b* with the small diameter is brought into press-contact on the upstream side, the third roller 50 is brought into press-contact on the downstream side, and thereby, the first nip portion Np1 for first folding and the second nip portion Np2 for second folding are formed.

Further, the first roller 41*b* is disposed in the position such that part of the periphery faces the first path 32, and the pinch roller (floating roller) 41*a* is brought into press-contact with the periphery of the roller 41*b*. By this means, the sheet in the first path 32 is fed to the downstream side by the first roller 41*b* and pinch roller 41*a*, and it is not necessary to provide the first path 32 with specific transport means and driving mechanism thereof.

[Configuration of the Folding Deflecting Means]

In the folding rollers comprised of three rollers (41*b*, 49, 50) as described above, the first folding deflecting means 53 is disposed in the first nip portion Np1, and the second folding deflecting means 54 is disposed in the second nip portion Np2. The first folding deflecting means 53 and the second folding deflecting means 54 are formed of a mechanism that fold positions of the sheet fed to the second path 33 are inserted in the first nip portion Np1 and the second nip portion Np2.

In the apparatus as shown in the figure, the first folding deflecting means 53 and the second folding deflecting means 54 are provided with the function of "inserting the fold position of the sheet in a roller nip portion" and the function of "feeding the front end and rear end of the sheet to the nip portion". Therefore, each of the first and second folding deflecting means 53, 54 is provided with a driven roller and curved guide, and is configured to shift to positions from a withdrawal position outside the path to an actuation position inside the path. Then, by the operation of the driven roller and curved guide shifting from the withdrawal position to the actuation position, the fold position of the sheet is inserted in the nip portion, and then, the driven roller comes into press-contact with the periphery of the folding roller to rotate by being driven, and thereby acts to feed the front and rear ends of the sheet to feed to the nip portion.

[Configuration of the First Folding Deflecting Means]

As shown in FIGS. 4(*a*)-4(*c*) and 5(*a*), 5(*b*), to guide the fold of the sheet to the first nip portion (press-contact point) Np1, the first folding deflecting means 53 is comprised of a driven roller 53*a*, curved guide 53*b* and up-and-down member 53*c*.

Figure 5A:
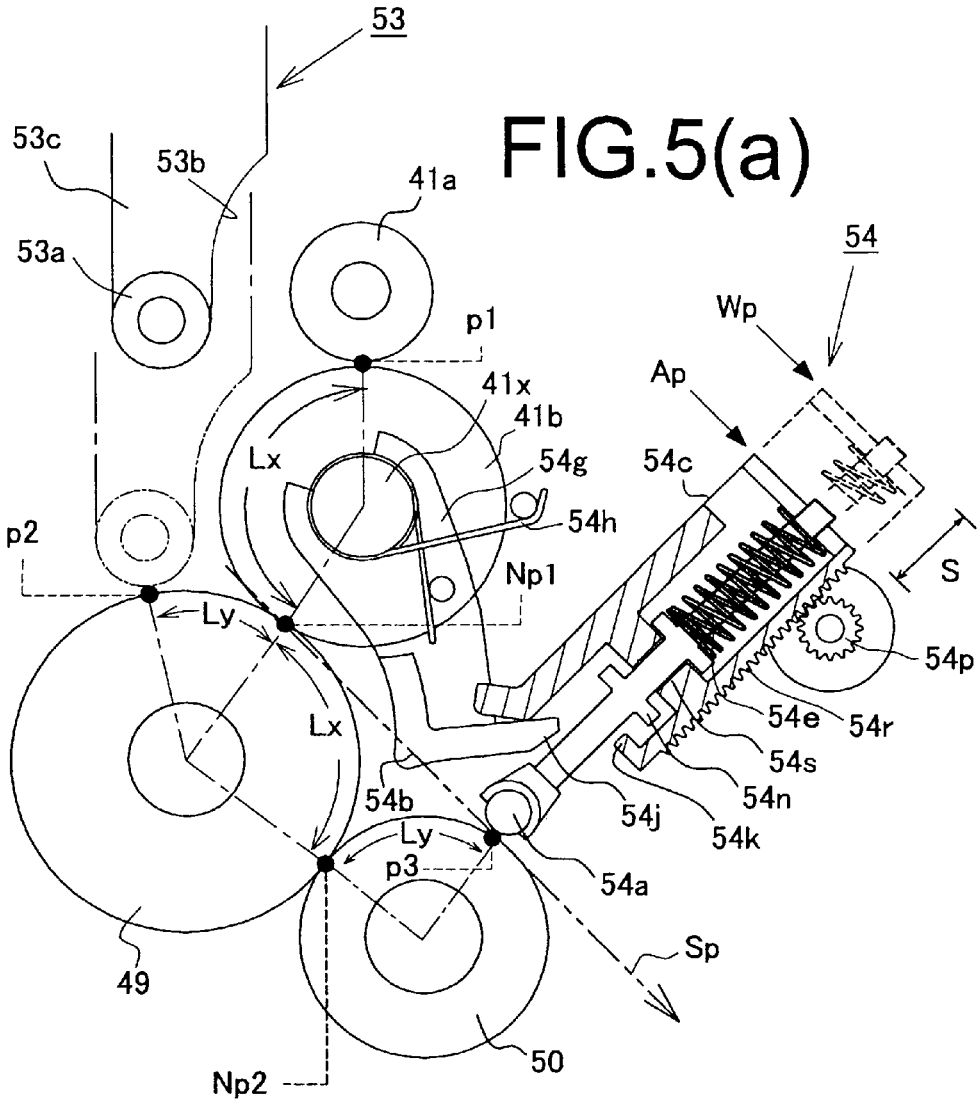
FIGS. 5(*a*), 5(*b*) contain explanatory views showing a layout configuration of folding rollers of FIG. 3 and second folding deflecting means.
Figure 5B:
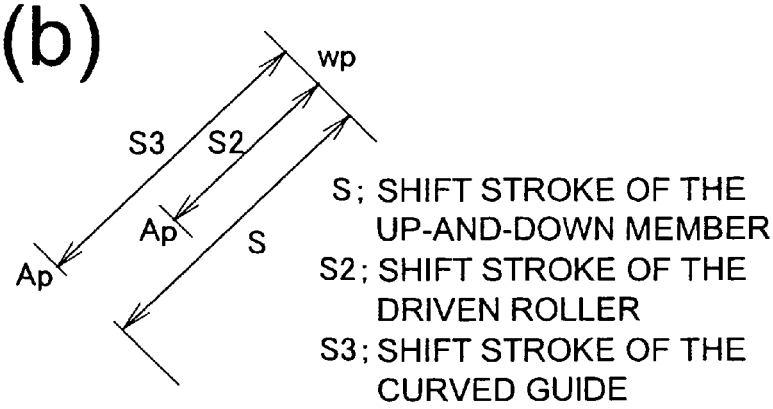

As shown in FIG. 5(*a*), the first nip portion Np1 for first folding the sheet is comprised of the first roller 41*b* and second roller 49, the first roller 41*b* is disposed on the upstream side, and the second roller 49 is disposed on the downstream side. Thus, the driven roller 53*a* is disposed in a position for coming into contact with the periphery of the second roller 49. Then, the curved guide 53*b* is configured to be a curved surface along the periphery of the first roller 41*b* positioned on the upstream side.

The driven roller 53*a* and the curved guide 53*b* are supported by the up-and-down member 53*c*. The up-and-down member 53*c* is comprised of a bracket member (frame member) of an appropriate shape, the driven roller 53*a* is supported rotatably by the up-and-down member 53*c*, and concurrently, the curved guide 53*b* is fixed to the member 53*c*. Then, the up-and-down member 53*c* is supported by a guide rail (not shown) provided in the apparatus frame, and is configured to move up and down between an actuation position (dashed-line position in FIG. 4(*a*)) in which the driven roller 53*a* comes into contact with the periphery of the second roller 49, and a waiting position (solid-line position in FIG. 4*a*) in which the driven roller 53*a* retracts out of the second path 33. The up-and-down member 53*c* is coupled to a shift motor MS described later, and shifts positions of the driven roller 53*a* and curved guide 53*b* between the actuation position and the waiting position.

Then, the above-mentioned driven roller 53*a* comes into press-contact with the second roller 49 positioned on the downstream side, and the press-contact point is shown by p2 in FIG. 5(*a*). Then, when the fold position of the sheet is guided to the first nip portion Np1, the rear end side of the sheet is provided with the transport force in the press-contact point p1, and is guided to the first nip portion Np1 along the periphery of the first roller 41*b*. Further, the front end side of the sheet is provided with the transport force in the press-contact point p2, and is guided to the first nip portion Np1 along the periphery of the second roller 49.

At this point, the transport length Lx between the press-contact point p1 and the first nip portion Np1 and the transport length Ly between the press-contact point p2 and the first nip portion Np1 are set at Lx>Ly. The position of the driven roller 53*a* is set in such a transport length relationship. Then, the curved guide 53*b* described previously forms the curved guide surface in the shape of a curve along the periphery of the first roller 41*b* with the longer transport length.

In other words, conventionally, the blade member for guiding a fold of the sheet to the nip portion Np1, Np2 has been provided separately from the sheet feeding means, and has becomes a cause of displacement of the fold or wrinkle occurring in the sheet by timing deviation acting on the sheet. To solve the problem, in the apparatus as shown in the figure, the transport length Lx of the first roller 41*b* on the upstream side of the sheet fed to the first nip portion Np1 and the transport length Ly of the second roller 49 on the downstream side are set at [Lx>Ly], concurrently the curved guide surface of the curved guide 53*b* is configured in the shape for bringing the sheet along the periphery of the first roller 41*b* with the longer transport length, and the driven roller 53*a* and the curved guide 53*b* are concurrently shifted from the waiting position to the actuation position.

By thus configuring, it is possible to guide the fold of the sheet correctly to the first nip portion Np1 without using particular folding blade means. In addition, as can be seen from FIG. 5(*a*), to set the transport lengths at [Lx>Ly], it is necessary to make the roller diameter of the driven roll 53*a* smaller than the roll diameter of the first roller 41*b* positioned on the upstream side.

[Configuration of the Second Folding Deflecting Means]

The second folding deflecting means 54 will be described next. As shown in FIGS. 4(*a*)-4(*c*) and 5(*a*), 5(*b*), the second folding deflecting means 54 is comprised of the up-and-down member 54*c*, a driven roller 54*a* attached to the up-and-down member 54*c*, and a curved guide 54*b*. The driven roller 54*a* is disposed in a position opposite the periphery of the third roller 50 positioned on the downstream side of the second roller 49, and the curved guide 54*b* is disposed in a position opposite the periphery of the second roller 49 positioned on the upstream side.

Concurrently therewith, the driven roller 54*a* and the curved guide 54*b* are configured to shift to positions between a withdrawal position Wp withdrawn from the carrying path (hereinafter, referred to as a sheet path Sp; see FIG. 5(*a*)) of the sheet and an actuation position Ap entering inside the sheet path Sp by the up-and-down member 54*c*.

As shown in FIG. 5(*a*), the up-and-down member 54*c* is disposed to reciprocate in a predetermined stroke S along a guide rail (not shown) provided in the apparatus frame. In the up-and-down member 54*c*, a rack 54*r* is integrally formed, and a pinion 54*p* meshing with the rack 54*r* is disposed on the apparatus frame side. Then, driving of the shift motor MS described later is conveyed to the pinion 54*p*. Therefore, by forward and backward rotation of the shift motor MS, driving is conveyed to the pinion 54*p* so that the rack 54*r* reciprocates in the predetermined stroke S.

The up-and-down member 54*c* is provided with a sleeve 54*s*, and a support stem of the driven roller 54*a* (hereinafter, the roller and the support stem supporting the roller are simply referred to as a "driven roller") is fitted with the sleeve 54*s* slidably. Thus, the driven roller 54*a* is fitted and supported by the up-and-down member 54*c* reciprocating in the predetermined stoke S, and shifts to positions between the withdrawal position Wp and the actuation position Ap by the up-and-down member 54*c* shifting.

Then, an adjuster spring 54*e* is provided between the driven roller 54*a* fitted with the sleeve 54*s* and the up-and-down member 54*c*, and the driven roller 54*a* is biased in the direction of the third roller 50 by the adjuster spring 54*e*. Concurrently therewith, an engagement protrusion 54*k* is integrally provided in the up-and-down member 54*c*. The engagement protrusion 54*k* engages in the driven roller 54*a* (flange portion 54*n* of the support stem).

Meanwhile, the curved guide 54*b* is swingably supported by the apparatus frame. The guide as shown in the figure is integrally formed in a bracket 54*g* freely fitted with a rotary shaft 41*x* of the first roller 41*b*, and the guide surface of the curved guide 54*b* is disposed in a position opposite the periphery of the second roller 49. Then, the curved guide 54*b* is engaged to shift to positions between the withdrawal position Wp withdrawn from the sheet path Sp and the actuation position Ap entering inside the path in conjunction with reciprocating of the up-and-down member 54*c*.

Therefore, the bracket 54*g* is provided with a biasing spring 54*h* for biasing toward the withdrawal position Wp and engagement piece 54*j*. The engagement piece 54*j* engages with the up-and-down member 54*c*, and is configured to shift from the withdrawal position Wp to the actuation position Ap in conjunction with the shift of the up-and-down member 54*c* (against the biasing spring 54*h*).

In the above-mentioned configuration, the up-and-down member 54*c* and the shift motor MS constitute the "shift means" for shifting the driven roller 54*a* and curved guide 54*b* to positions between the withdrawal position Wp and the actuation position Ap. Further, as a substitute for the configuration of the up-and-down member 54*c* reciprocating in a predetermined stroke, it is naturally possible to constitute the shift means using an actuator such as an actuation solenoid. In this case, the driven roller 54*a* and the curved guide 54*b* are coupled to a single actuation solenoid, or individual actuation solenoids.

[Operation of the Second Folding Deflecting Means]

Figure 6A:
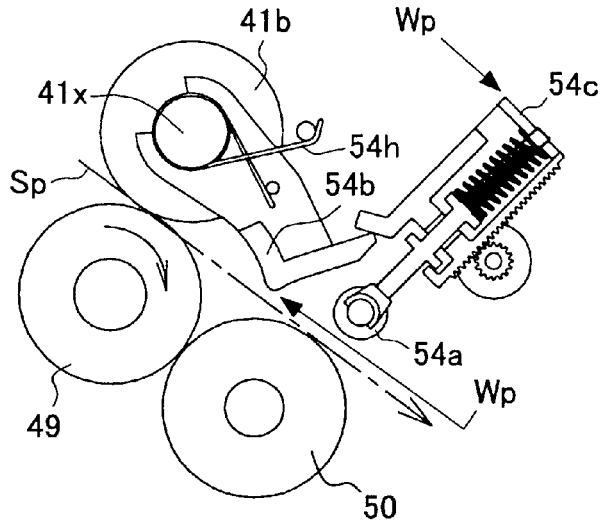
FIGS. 6(*a*)-6(*c*) contain explanatory views of an operating state of the second folding deflecting means of FIG. 5(*a*), where FIG. 6(*a*) shows a waiting state, FIG. 6(*b*) shows a state when a driven roller is in an actuation position, and FIG. 6(*c*) shows a state when a curved guide is in an actuation position.
Figure 6B:
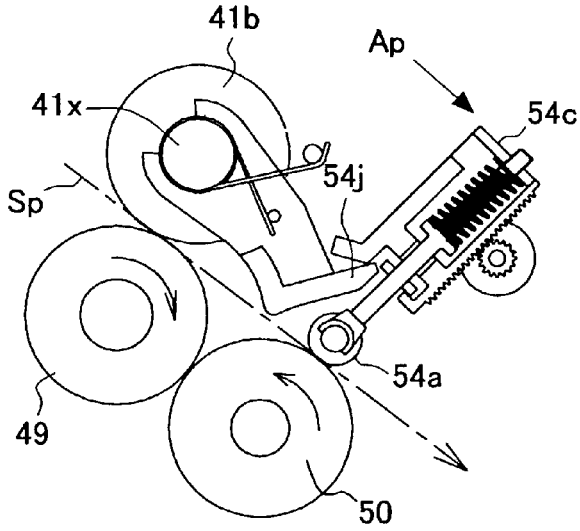
Figure 6C:
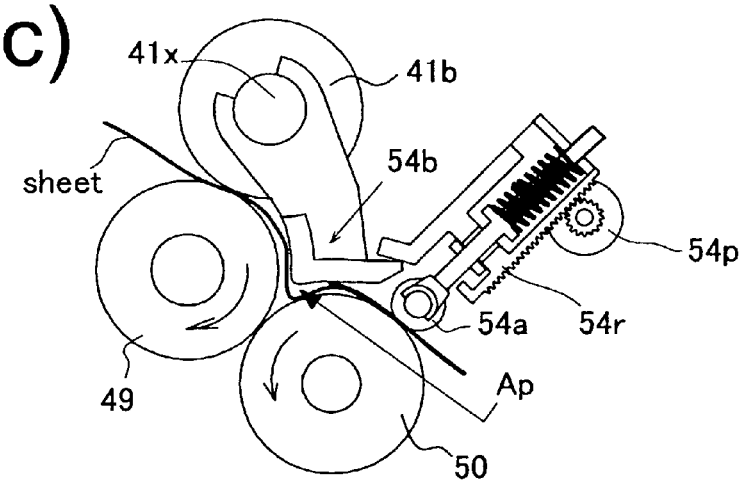

Then, the operation of the second folding deflecting means 54 will be described according to operating state views of FIGS. 6(*a*) to 6(C). A sheet such that the sheet front end is folded in the first folding position Np1 is fed to the second switchback path 34 in the state of FIG. 6(*a*). At this point, the driven roller 54*a* and curved guide 54*b* are positioned in the withdrawal position Wp withdrawn from the sheet path Sp. As in the figure, the withdrawal position Wp of the driven roller 54*a* and curved guide 54*b* is set outside the path apart from the sheet path Sp. In the state of FIG. 6(*a*), the driven roller 54*a* is positioned in the withdrawal position Wp, and the curved guide 54*b* is also positioned in the withdrawal position Wp. Then, the withdrawal position Wp is set at a position withdrawn from the sheet path Sp to the outside of the path.

Next, after a lapse of the predicted time (for example, a detection signal of a front end detecting sensor S2 described later) the sheet front end reaches a predetermined position of the second switchback path 34, the up-and-down member 54*c* is shifted from the withdrawal position (top dead center) Wp to the actuation position (bottom dead center) Ap side. Then, as in the state of FIG. 6(*b*), the driven roller 54*a* comes into contact with the periphery of the third roller 50, and brings the front end of the folded sheet into press-contact. At this point, the up-and-down member 54*c* and the engagement piece 54*j* of the curved guide 54*b* are arranged in the position relationship such that the curved guide 54*b* is positioned in the withdrawal position that is not inside the sheet path Sp. In the state of FIG. 6(*b*), the driven roller 54*a* is positioned in the actuation position Ap, and the curved guide 54*b* is positioned in the position approaching the sheet path Sp. Then, the position of the curved guide 54*b* is set at the position apart from the sheet path Sp and thus outside the path.

The curved guide 54*b* is thus configured to enter inside the sheet path Sp (the state of FIG. 6(*b*)) after the driven roller 54*a* brings the sheet front end into press-contact with the periphery of the third roller 50, and by this means, the fold position of the sheet is not misaligned by the curved guide 54*b*.

Then, after the driven roller 54*a* comes into contact with the periphery of the third roller 50, the driven roller 54*a* rotates according to the rotation of the roller 50, and transports reversely (switchback-transports) the sheet front end toward the second folding position Np2. At this point, when the curved guide 54*b* is halted, the sheet front end may strike the guide 54*b* and be folded. To cope therewith, after entering into the sheet path Sp, the curved guide 54*b* shifts toward the actuation position Ap, and therefore, inserts the fold position of the sheet in the second nip portion Np2 without the sheet front end folding occurring.

This state is shown in FIG. 6(*c*), where the up-and-down member 54*c* further performs overrun operation after the driven roller 54*a* comes into contact with the periphery of the third roller 50 in a predetermined stroke, and shifts the curved guide 54*b* to the actuation position Ap close to the second nip portion Np2. At this point, in the driven roller 54*a*, the adjuster spring 54*e* is compressed and allows the overrun operation of the up-and-down member 54*c*. In the state of the FIG. 6(*c*), each of the curved guide 54*b* and driven roller 54*a* is positioned in the actuation position Ap. Then, after the driven roller 54*a* is positioned in the actuation position Ap, the curved guide 54*b* enters into the sheet path Sp, and inserts the front end portion of the sheet that is fed reversely by the driven roller 54*a* in the second nip portion Np2 by the operation of shifting the position to the actuation position.

Thus, in the up-and-down member 54*c*, driven roller 54*a* and curved guide 54*b*, after the roller 54*a* shifts to the actuation position and brings the folded sheet front end into press-contact with the folding roller periphery, the curved guide 54*b* enters into the sheet path Sp from the withdrawal position Wp to shift position to the actuation position Ap.

In the apparatus as shown in FIG. 5(*a*), the shift means is provided with the actuation member (up and down member 54*c*) that is coupled to the shift motor MS to reciprocate in a predetermined stroke, and each of the driven roller 54*a* and curved guide 54*b* is coupled to the actuation member 54*c* to reciprocate between the withdrawal position Wp and the actuation position Ap.

Then, as shown in FIG. 5(*b*), with respect to the shift stroke S of the up-and-down member 54*c*, the stroke length S2 by which the driven roller 54*a* reciprocates is set to be shorter than the stroke length S3 by which the curved guide 54*b* reciprocates. By this means, after the driven roller 54*a* brings the sheet front end portion into press-contact with the folding roller periphery, the curved guide 54*b* enters inside the sheet path Sp.

As well as thus setting the strokes, in association with the up-and-down member 54*c* that reciprocates in a predetermined stroke, it may be configured that the driven roller 54*a* is coupled to the up-and-down member 54*c* to synchronize at first timing, and that the curved guide 54*b* is coupled to the up-and-down member 54*c* to next synchronize at second timing.

In other words, such a configuration is only essential that the driven roller 54*a* first comes into contact with the periphery of the third roller 50 (actuation position), and the curved guide 54*b* does not enter inside the sheet path Sp at the timing, then enters into the sheet path Sp while being delayed after the driven roller 54*a* shifts to the actuation position, and further shifts to the actuation position Ap inside the sheet path to insert the sheet in the second nip portion Np2.

As in the first folding deflecting means 53, in the second folding deflecting means 54, [Lx>Ly] is set on the transport length Lx from the first nip portion Np1 of the second roller 49 positioned on the upstream side for providing the sheet with the transport force to the second nip portion Np2, and the transport length Ly between the press-contact point p3 of the driven roller 54*a* and the third roller 50 positioned on the downstream side, and the second nip portion Np2.

Then, the curved guide surface of the curved guide member 54*b* is configured in the shape of bringing the sheet along the periphery of the second roller 49 with the long transport length. In addition, the second folding deflecting means 54 and the first folding deflecting means 53 shift in a relatively opposite manner so that one is in the actuation position when the other one is in the Waiting position. This is because the up-and-down member 53*c* and the up-and-down member 54*c* are moved up and down by the same driving means (described later).

[Sheet Transport Mechanism]

The sheet transport mechanism of the first path 32 and second path 33 will be described according to FIG. 3. In the first path 32, the carry-in roller pair 40 is disposed in the carry-in exit (carry-in portion) 30, the carrying-out roller pair 62 is disposed in the carrying-out exit (carrying-out portion) 31, and a register roller is disposed between the rollers. The register roller shown in the figure is comprised of the periphery of the first roller 41*b* described later and the pinch roller 41*a* in press-contact with the roller 41*b*. Accordingly, in the first path 32 are disposed the carry-in roller pair 40, carrying-out roller pair 62 and register roller (first roller) 41*b*.

Then, the carry-in roller pair 40 is comprised of a pair of rollers 40*a*, 40*b*, and one of the rollers, 40*b*, is coupled to a feeding motor Mf described later. Similarly, the carrying-out roller pair 62 is comprised of a pair of rollers 62*a*, 62*b*, and one of the rollers, 62*b*, is coupled to the feeding motor Mf. Further, the pinch roller 41*a* is disposed to rotate in accordance with the first roller 41*b*, and the first roller 41*b* is also coupled to the feeding motor Mf.

In the second transport path 33 are disposed the first roller 41*b*, second roller 49 and third roller 50 coming into press-contact with one another, and the sheet discharge roller 67 is disposed in the sheet discharge path 37. Then, as shown in FIG. 3, the second path 33 (first switchback path 34 and second switchback path 35) is not provided with the sheet transport mechanism. Then, to the second path 33, the sheet is carried in the first switchback path 34 by the carry-in roller pair 40 and the register roller (first roller) 41*b* disposed in the first path 32, and is fed to the downstream side by the first and second rollers 41*b*, 49.

The apparatus shown in the figure is characterized by simplifying the sheet transport mechanism disposed in the first and second paths 32, 33 and thereby reducing the size, noise and power consumption of the apparatus. Therefore, in the first path 32, part of the periphery of the folding roller (first roller 41*b*) disposed in the second path 33 is arranged to face the first path 32 in between the carry-in roller pair 40 and the carrying-out roller pair 62.

Then, the pinch roller 41*a* is disposed around the periphery of the first roller 41*b* to carry the sheet fed from the carry-in roller pair 40 to the first switchback path 34. By this means, it is not necessary to provide a specific transport roller in the first path 32, and it is possible to achieve simplification of the transport mechanism.

Concurrently therewith, the first roller 41*b* is rotated in performing the folding processing on the sheet in a mode (first transport mode described later) for carrying the sheet from the carry-in roller pair 40 to the first switchback path 34 by the carry-in roller pair 40 and the first roller 41*b*, while being halted so that the sheet is fed from the carry-in entrance 30 to the carrying-out exit 31 by the carry-in roller pair 40 and the carrying-out roller pair 62 in a mode (second transport mode described later) for carrying a sheet from the carry-in entrance 30 to the carrying-out exit 31 without performing the folding processing on the sheet. By this means, it is possible to achieve reductions in power consumption and low-noise operation.

[Register Mechanism]

The first path 32 as described previously is provided with a register mechanism for aligning the front end of the sheet fed from the carry-in roller pair 40, and the mechanism will be described according to FIGS. 4(*a*)-4(*c*). In the path 32, as described previously, the carry-in roller pair 40 is disposed in the carry-in entrance 30, and the carrying-out roller pair 62 is disposed in the carrying-out exit 31. The first roller 41*b* is disposed between the carry-in roller pair 40 and the carrying-out roller pair 62 so that part of the periphery of the roller 41*b* faces the first path 32, and the pinch roller 41*a* is brought into press-contact with the first roller periphery.

On the upstream side of the first roller 41*b*, a register area Ar and gate stopper 43 are disposed in between the roller 41*b* and the carry-in roller pair 40. The register area Ar is formed of a path guide member 32*g* in the shape of curving the sheet which is fed by the carry-in roller pair 40 and locked in the front end by the gate stopper 43. The gate stopper 43 is comprised of a lever member having a lock surface 43*s* for striking the sheet front end, and is axially supported in the spindle 43*x* by the apparatus frame to be swingable. Then, the gate stopper 43 is configured to shift to the solid-line state (actuation state) and the dashed-line state (waiting state) in FIG. 4(*b*) by a gate driving mechanism described later.

Further, the pinch roller 41*a* is configured to be able to come into press-contact and separate with/from the first roller 41*b*. In the mechanism as shown in FIG. 4(*a*), the pinch roller 41*a* is supported rotatably by a bracket 42, and the bracket 42 is bearing-supported in the spindle 42*x* by the apparatus frame to be swingable. By such a configuration, the gate stopper 43 and the pinch roller 41*a* are able to travel between an actuation position inside the first path 32 shown by the solid line and a non-actuation position outside the path shown by the dashed line in FIG. 4(*b*).

Meanwhile, the carry-in roller pair 40 is comprised of a roller pair of the roller 40*a* positioned on the register area Ar side and the roller 40*b* positioned on the side opposite to the register area Ar, and as shown in FIG. 4(*b*), is disposed while being inclined a predetermined angle (shown by 0 in the figure) so that the tangent direction (A direction shown by the arrow in the figure) of the press-contact point of the roller pair guides the sheet to the register area Ar.

Concurrently therewith, the diameter da of the roller 40*a* positioned on the register area side is set to be smaller than the diameter db of the roller 40*b* positioned on the side opposite to the register area Ar (da<db), and the roller outer region of the roller 40*a* is configured to be harder than that of the roller 40*b*. In the apparatus as shown in the figure, the roller 40*a* is made of a hard resin such as Derlin, and the roller 40*b* is made of a soft material such as rubber.

Thus, since the carry-in rollers 40*a*, 40*b* are inclined a predetermined angle θ (for example, 12 degrees), the sheet from the carry-in entrance 30 is guided at the front end to the register area side in the arrow A direction. Further, since the roller 40*a* positioned on the register area side is configured to be smaller in the diameter and harder than the roller 40*b* positioned on the side opposite to the register area Ar, a curved concave portion 40*q* is formed in the press-contact portion of the rollers as shown in FIG. 4(*c*), and therefore, even when the sheet is curled in the direction opposite to the register loop, the sheet is decurled in the concave portion 40*q*.

Accordingly, when the sheet from the carry-in entrance 30 is formed in the shape of a register loop in the register area Ar by operating the gate stopper 43 (first transport mode described later), the sheet front end is reliably registered and aligned. Concurrently therewith, when the sheet from the carry-in entrance 30 is carried to the carrying-roller pair 62 without undergoing register correction with the gate stopper 43 withdrawn (second transport mode described later), it is possible to transport the sheet to the carrying-out roller pair 62 with a relatively long transport path with low friction resistance. In other words, since the sheet is fed out of the carry-in roller pair 40 toward the carrying-out roller pair 62 in the arrow A direction, the friction resistance of the transport guide in sliding-contact with the sheet is reduced.

The apparatus shown in the figure described later is provided with the first transport mode for performing the folding processing on a sheet from the carry-in entrance 30 in the second path 33 to carry to the carrying-out exit 31, and the second transport mode for carrying a sheet from the carry-in entrance 30 to the carrying-out exit 31 in the first path 32 without performing the folding processing. Then, in the first transport mode, the gate stopper 43 and pinch roller 41*a* are positioned in the actuation position inside the first path, and the first roller 41*b* in sliding-contact with the pinch roller 41*a* is driven and rotated to make a register correction to the sheet front end. In the second transport mode, the gate stopper 43 and pinch roller 41*a* are positioned in the withdrawal position outside the first path, and the sheet is carried to the carrying-out exit 31 without undergoing the register correction. In the second transport mode, driving transfer is made OFF to halt the first roller 41*b*.

[Guide Cover Mechanism of the First Roller]

As described above, in the second transport mode, the gate stopper 43 and pinch roller 41*a* are withdrawn from the first path to the outside, and the sheet is carried from the carry-in entrance 30 to the carrying-out exit 31 without undergoing the register correction. Therefore, a guide cover mechanism is required to cover in order for the sheet not to contact the periphery of the first roller 41*b* facing the first path 32 in the second transport mode.

FIGS. 4(*a*), 4(*b*) show the guide cover mechanism, and the first path 32 is provided with a guide cover 44 covering the periphery of the first roller 41*b*. The guide cover 44 is configured to be able to shift to positions between an actuation position (shown by the dashed line in FIG. 4(*b*)) to cover so that the sheet carried in the first path 32 does not contact the periphery of the first roller 41*b* and a non-actuation position (shown by the solid line in FIG. 4(*b*)) such that the sheet engages with the periphery of the first roller 41*b*.

The guide cover 44 is comprised of a plate member (resin film, etc.) covering the periphery facing the first path 32 of the first roller 41*b*, and is fixed to a bracket 44*b* freely fitted with the rotary shaft 41*x* of the first roller 41*b*. Then, the bracket 44*b* is provided with guide shift means comprised of the feeding motor Mf described later.

Then, by rotation of the feeding motor Mf (guide shift means), the guide cover 44 shifts to positions between the non-actuation position shown by the solid line in FIG. 4(*b*) and the actuation position shown by the dashed line in the figure. The guide shift means may be comprised of an electromagnetic solenoid, and in the means shown in the figure, a clutch mechanism described later is configured so that the guide cover 44 shifts to the actuation position by forward rotation of the feeding motor Mf, while shifting to the non-operation position by backward rotation. Then, the surface of the guide cover 44 is comprised of a material (for example, resin film such as Mylar) with the coefficient of friction sufficiently lower than the coefficient of friction of the periphery of the first roller 41*b*.

[Configuration of the Gate Stopper Means]

The gate stopper means is comprised of the stopper member (gate stopper) 43 provided with the lock surface 43*s* to strike the sheet front end to regulate, and a stopper driving mechanism for shifting the lock surface 43*s* to positions between a lock position Ps inside the first path and a waiting position Pw outside the path.

Figure 11A:
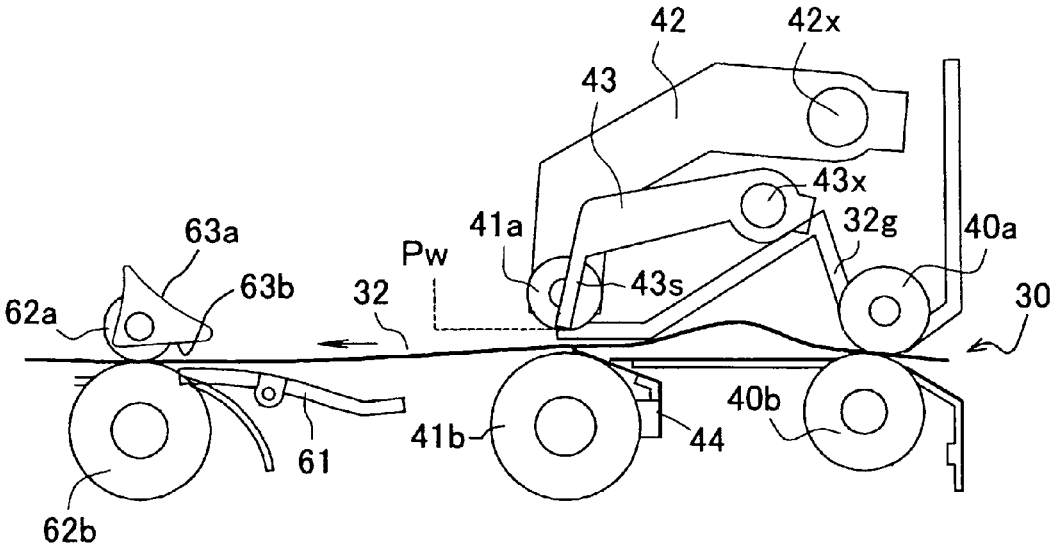
FIGS. 11(*a*), 11(*b*) contain explanatory views of an operating state of the apparatus of FIG. 3, where FIG. 11(*a*) shows a state of a first transport mode for carrying a sheet to a carrying-out exit without performing folding processing, and FIG. 11(*b*) shows a sheet front end aligning state in a second transport mode for performing the folding processing.
Figure 11B:
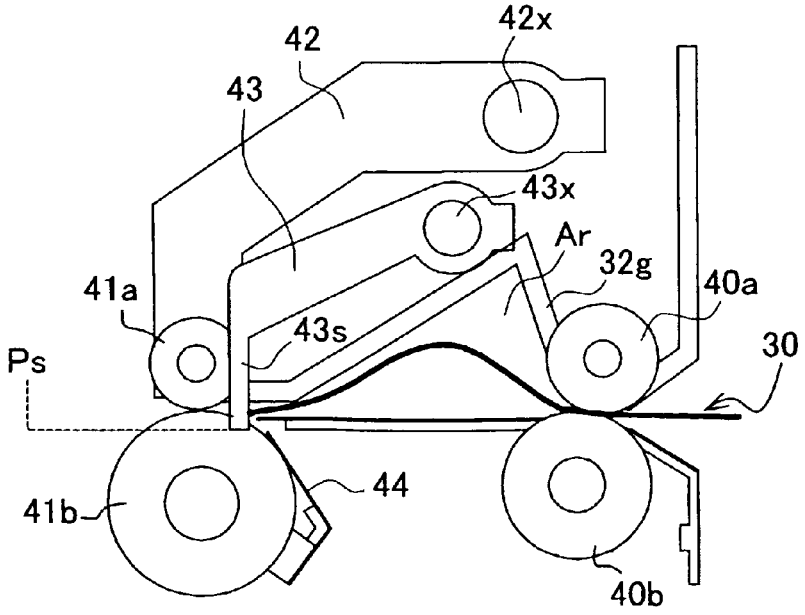

The stopper member (gate stopper) 43 shown in FIGS. 11(*a*), 11(*b*) is comprised of a lever member, axially supported at the base end portion by the apparatus frame so as to swing on the spindle 43*x*, and provided with the lock surface 43*s* for regulating the sheet front end moving in the first path 32 formed in the front end portion. A driving mechanism for shifting the stopper member (gate stopper) 43 to positions between the waiting position Pw and actuation position Ps will be described later. Further, the register area Ar is comprised of space for deforming the sheet in the shape of a loop by curving the path guide member 32*g* constituting the first path 32 as shown in FIG. 4(*b*).

[Driving Mechanism]

The driving mechanism of the apparatus as shown in FIG. 3 will be described next. In the apparatus of FIG. 3, the carry-in roller pair 40, carrying-out roller pair 62 and first roller 41*b* constituting part of the folding rollers are disposed in the first path 32. Further, folding roller pairs (first roller 41*b*, second roller 49 and third roller 50) and sheet discharge roller 67 are disposed in the second path 33. In the second path 33, any other transport means such as a roller and belt for providing a sheet with the transport force is not provided in the first switchback path 34 and second switchback path 35 constituting the second path 33.

Then, the apparatus of the FIG. 3 is provided with the "feeding motor Mf" and "shift motor MS". Concurrently therewith, control means 95 described later is provided with the first transport mode for carrying a sheet from the carry-in entrance 30 in the folding processing path (second path) 33 to perform the folding processing, and the second transport mode for carrying a sheet from the carry-in entrance 30 to the carrying-out exit 31 without carrying the sheet to the folding processing path (second path) 33.

Then, in the first transport mode, a sheet from the carry-in entrance 30 is fed to the first switchback path 34 of the second path 33 by the carry-in roller pair 40 and the first roller 41*b*. In this mode, with the pinch roller 41*a* brought into press-contact with the first roller 41*b*, the gate stopper means 43 is switched between ON (actuation position) and OFF (withdrawal position) to align the front end of the sheet in the register area Ar, and then, the sheet is fed to the first switchback path 34.

Meanwhile, in the second transport mode, a sheet from the carry-in entrance 30 is carried to the carrying-out exit 31 by the carry-in roller pair 40 and the carrying-out roller pair 62. In this mode, the first roller 41*b* is halted (non-actuation state), and the pinch roller 41*a* is withdrawn from the path to the outside. The reason for making the sheet transport form of the first path 32 different between the first transport mode and the second transport mode is to perform low-noise operation at saved power in the second transport mode.

Figure 8:
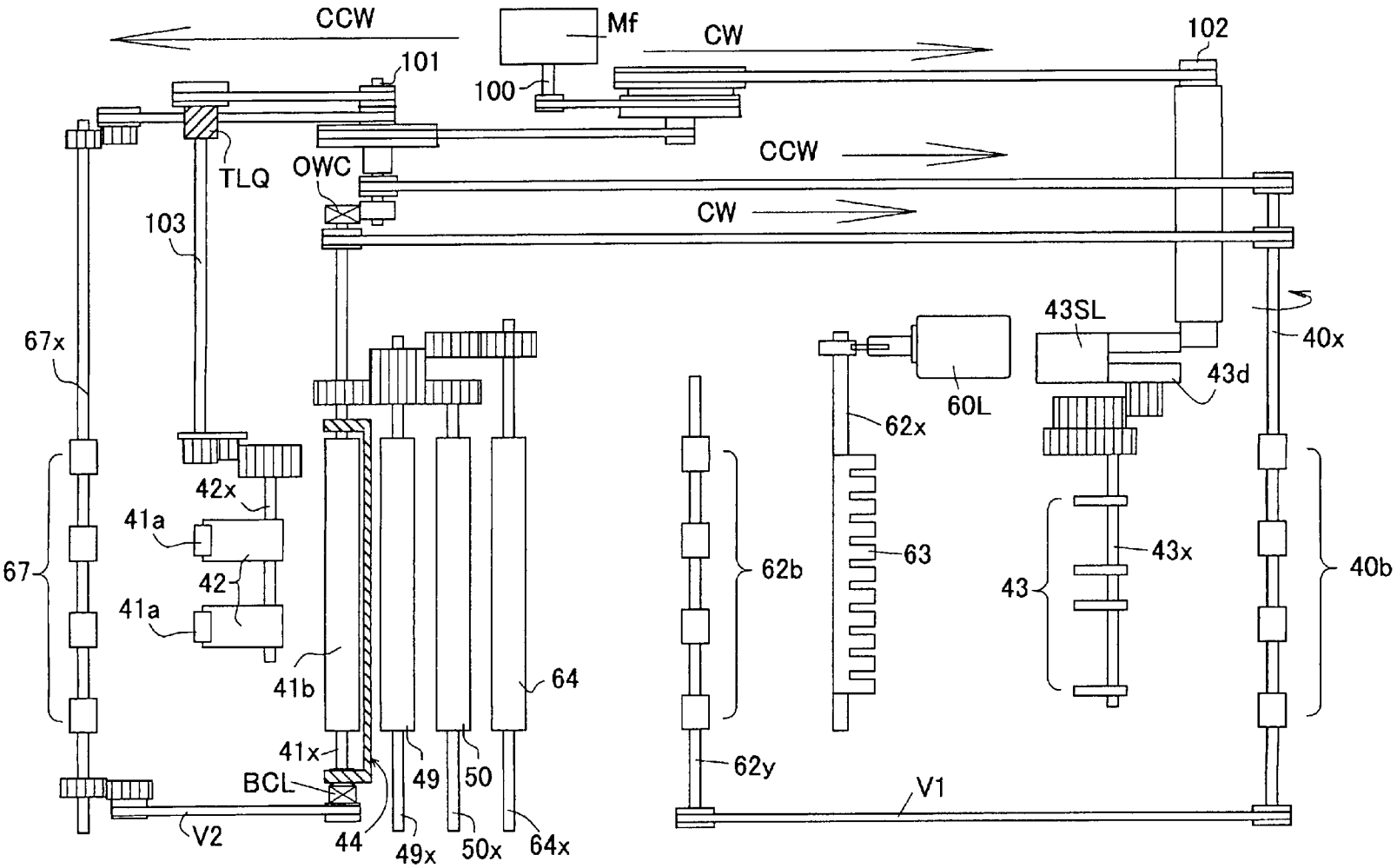
FIG. 8 is an explanatory view of a driving mechanism according to sheet transport in the apparatus of FIG. 3.

FIG. 8 shows the driving mechanism of the "feeding motor Mf", where a motor rotary shaft 100 conveys rotation in the forward direction (CW) and rotation in the backward direction to the rotary shaft 40*x* of the carry-in roller 40*b* via an intermediate shaft 101, and the rotation is conveyed to the rotary shaft 62*y* of the carrying-out roller 62*b* via a transmission belt V1.

By this means, the forward and backward rotation of the feeding motor Mf is conveyed to the carry-in roller pair 40 and carrying-out roller pair 62 as rotation in the sheet discharge direction. CW shown in the figure denotes a transmission system of rotation in the forward direction, and CCW denotes a transmission system of rotation in the backward direction. By gear transmission, the rotation directions of the carry-in roller pair 40 and the carrying-out roller pair 62 are set at one direction.

Further, the rotary shaft 100 of the feeding motor Mf conveys the rotation in the forward direction to the spindle 43*x* of the gate stopper 43 via the intermediate shaft 102, while conveying the rotation to the spindle 42*x* of the pinch roller 41*a* via an intermediate shaft 103. The transmission system is to shift in position the gate stopper 43 and the pinch roller 41*a* to the waiting position. Pw by the rotation in the forward direction CW of the motor, and will be described later including the clutch mechanism.

In rotation of the intermediate shaft 101, the rotation in the forward direction CW is only conveyed to the folding rollers via a one-way clutch OWC. As shown in FIG. 8, the rotation in the forward direction of the intermediate shaft 101 is transferred to the first roller 41*b*, second roller 49, third roller 50 and folding enhancement roller 64 by gear. In addition, the folding enhancement roller 64 will be described later in the configuration of the sheet discharge path.

The forward-direction rotation CW and backward-direction rotation CCW of the feeding motor Mf is conveyed to the rotary shaft 67*x* of the sheet discharge roller 67, and driving of the rotation is conveyed to the guide cover 44 via a transmission belt v2. In other words, the guide cover 44 disposed to cover the periphery of the first roller 41*b* is attached to the bracket 44*b* freely fitted with the rotary shaft 41*x*. Then, the bracket 44 shifts to the actuation position (dashed-line state of FIG. 4(*b*)) such that the guide cover 44 covers the periphery of the roller by action of spring clutch BCL when the feeding motor Mf is in the backward-direction rotation CCW, and after the bracket 44*b* is locked by a stopper not shown, the spring clutch BCL idles.

Figure 9A:
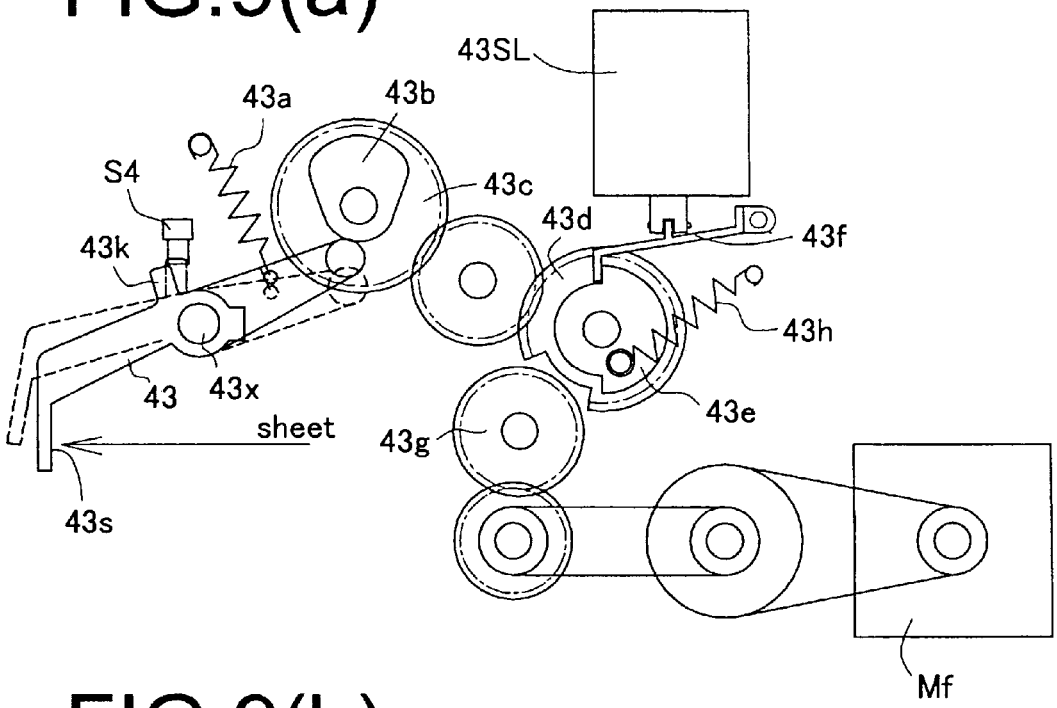
FIGS. 9(*a*)-9(*b*) show a driving mechanism in the apparatus of FIG. 3, where FIG. 9(*a*) shows driving of gate stopper means, and FIG. 9(*b*) shows a moving up/down mechanism of a pinch roller.
Figure 9B:
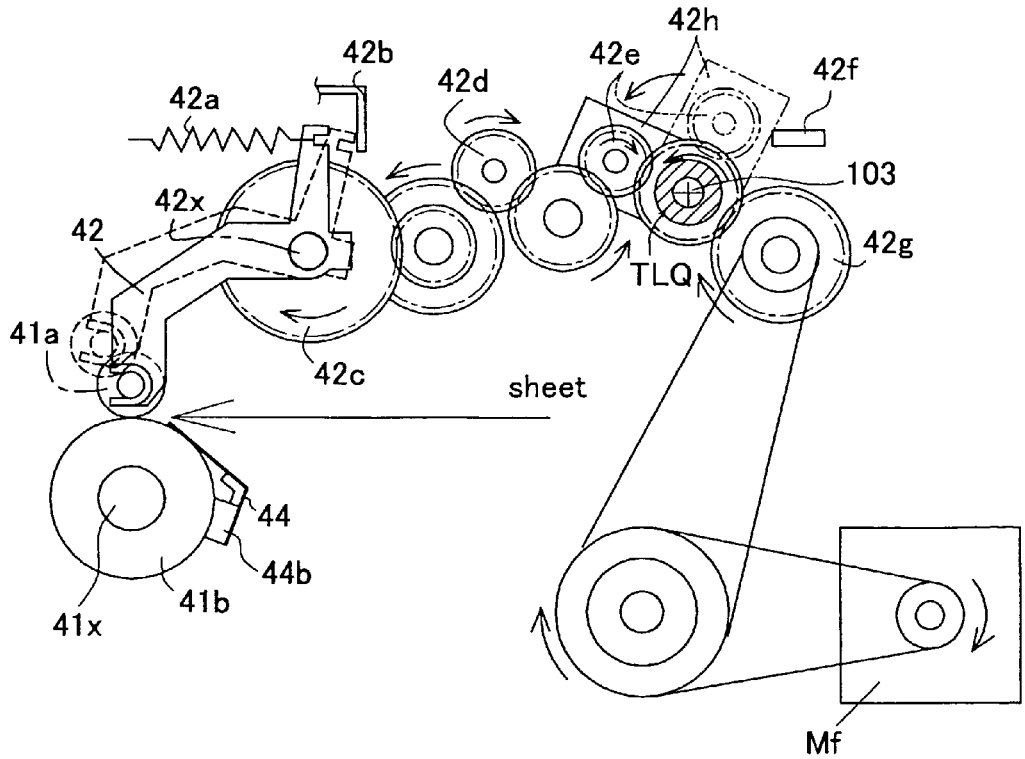

Driving of the gate stopper 43 and pinch roller 41*a* as shown in FIGS. 9(*a*), 9(*b*) will be described next. FIG. 9(*a*) shows the driving mechanism of the gate stopper 43, the gate stopper 43 swings on the spindle 43*x* as the center, and the lock surface 43*s* at the front end shifts to positions between the lock position Ps positioned in the first path 32 and the waiting position Pw outside the path. Then, in the first transport mode, the gate stopper 43 locks the sheet front end in the lock position Ps to make a register correction, and then, shifts to the waiting position Pw. Meanwhile, in the second transport mode, the gate stopper 43 is in a state positioned in the waiting position Pw.

Therefore, the gate stopper 43 is always biased to the lock position (solid line in FIG. 9(*a*)) by a spring 43*a*, and shifts the position to the waiting position (dashed line in FIG. 9(*a*)) by a cam 43*b*. Then, in the cam 43*b*, a cam gear 43*c* rotating integrally with the cam 43*b* is coupled to a teeth-lacked gear 43*d* by gear. A transmission gear 43*g* of the feeding motor Mf is mated with the teeth-lacked gear 43*d*. The teeth-lacked gear 43*d* and the transmission gear 43*g* mesh with each other not to convey driving in the teeth lacking portion. Then, the teeth-lacked gear 43*d* is integrally coupled to a control cam 43*e*.

In the control cam 43*e* are engaged a biasing spring 43*h* and actuation solenoid 43SL, the biasing spring 43*h* biases the teeth-lacked gear 43*d* in the transmission direction, and the actuation solenoid 43SL is engaged to lock the control cam 43*e* to the non-transmission state by a lock hook 43*f*. Accordingly, rotation of the feeding motor Mf is transferred to the teeth-lacked gear 43*d* by the transmission gear 43*g*, and the cam 43*b* rotates by the rotation. Then, the actuation solenoid 43SL is coupled to lock the transmission gear 43*g* and teeth-lacked gear 43*d* to the non-transmission state in the non-energized state, while conveying the rotation of the transmission gear 43*g* to the teeth-lacked gear 43*d* in the energized state.

In addition, in the cam 43*b* and the teeth-lacked gear 43*d*, the gear coupling rate is set so that a single rotation of the teeth-lacked gear 43*d* rotates the cam 43*b* half rotation (½ rotation). Then, the gate stopper 43 swinging up and down by the cam 43*b* is provided with a flag 43*k* and position sensor S4 (see FIG. 9(*a*)). Accordingly, the control cam 43*e* integrally formed in the teeth-lacked gear 43*d* shifts the gate stopper 43 to positions between the actuation position and the withdrawal position by two rotations.

Then, when the actuation solenoid 43SL is controlled from the ON state to the OFF state after the teeth-lacked gear 43*d* rotates once, the gate stopper 43 is positioned in the withdrawal position, and rests in the posit ion. Further, when the actuation solenoid 43SL is controlled from the ON state to the OFF state after the teeth-lacked gear 43*d* rotates twice, the gate stopper 43 shifts from the actuation position to the withdrawal position by first one rotation, and returns from the withdrawal position to the actuation position by next one rotation. The position sensor S4 is an abnormality detecting sensor that detects a state in which the gate stopper 43 is in the withdrawal position.

In such a configuration, the feeding motor Mf conveys the rotation of the motor to the cam 43*b* in the forward rotation (first transport mode). In the backward-direction rotation (second transport mode), the actuation solenoid 43SL is maintained at the non-energized state (OFF state), and driving is not conveyed in the teeth lacking portion of the teeth-lacked gear 43*d*.

The driving mechanism of the pinch roller 41*a* shown in FIG. 9(*b*) will be described next. As described previously, the pinch roller 41*a* is attached to the bracket 42, and the bracket 42 is configured to swing on the spindle 42*x* as the center. Therefore, the pinch roller 41*a* is kept always at the actuation position (solid line in FIG. 9(*b*)) by the biasing spring 42*a*. A gear 42*c* is coupled to the shaft portion of the bracket 42 to rotate integrally, and a clutch gear 42*e* meshes with the gear 42*c* via a transmission gear line 42*d*. A transmission gear 42*g* of the feeding motor Mf is coupled to the clutch gear 42*e* via a torque limiter TLQ.

The clutch gear 42*e* is supported by a planetary lever 42*h* swinging on the intermediate shaft 103 as described previously as the center, and the support shaft of the planetary lever is provided with a torque limiter TLQ. "42*f*" shown in the figure denotes a stopper for locking the clutch gear 42*e* to the non-transmission state. When the transmission gear 42*g* rotates in a counterclockwise direction (backward-direction rotation of the feeding motor; second transport mode), the planetary lever 42*h* swings in a clockwise direction, and the clutch gear 42*e* attached to the lever 42*h* meshes with the transmission gear line 42*d* and conveys rotation of the transmission gear 42*g* to the gear 42*c*.

Then, the bracket 42 integrated with the gear 42*c* shifts to the withdrawal position as the dashed-line state in FIG. 9(*b*). Subsequently, the bracket 42 engages in the stopper 42*b* and is locked in the position. At this point, the transmission gear line 42*d* and the clutch gear 42*e* idle by the torque limiter TLQ, are halted in rotation, and are locked in the state.

Then, when the feeding motor Mf rotates in the forward diction (first transport mode), the transmission gear 42*g* rotates in a clockwise direction, and the planetary lever 42*h* gear-coupled to the gear 42*g* rotates in a counterclockwise direction. In this state, the coupling between the clutch gear 42*e* and the transmission gear line 42*d* is released, and the clutch gear 42*e* and the transmission gear line 42*d* are locked in the state by the torque limiter TLQ.

Accordingly, in the forward-direction rotation of the feeding motor Mf (first transport mode), the rotation of the transmission gear 42*g* is not conveyed to the gear 42*c* of the bracket 42, and the pinch roller 41*a* is maintained at the state (the actuation position; solid line in FIG. 9(*b*)) in press-contact with the first roller 41*b* in the first path 32 by action of the biasing spring 42*a*.

Meanwhile, when the feeding motor Mf rotates in the backward direction (second transport mode), the transmission gear 42*g* rotates in a counterclockwise direction, the clutch gear 42*e* of the planetary lever 42*h* engages in the transmission gear line 42*d* by the rotation, and the pinch roller 41*a* shifts in position to the withdrawal position (dashed line in FIG. 9(*b*)) withdrawn from the first path 32 and is locked in the state.

[Driving Mechanism of the Shift Motor]

Figure 10A:
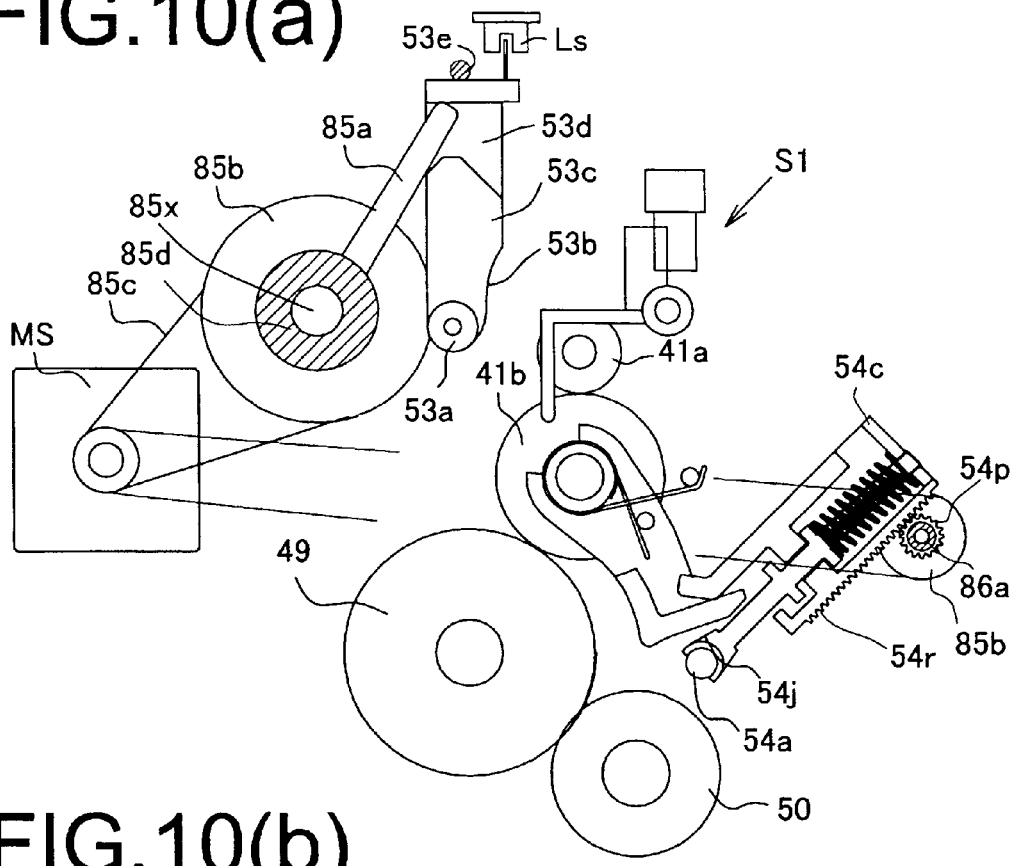
FIGS. 10(*a*), 10(*b*) contain explanatory views of a driving mechanism of first folding deflecting means and second folding deflecting means in the apparatus of FIG. 3, where FIG. 10(*a*) shows a state in a waiting position, and FIG. 10(*b*) shows a state in an actuation position.
Figure 10B:
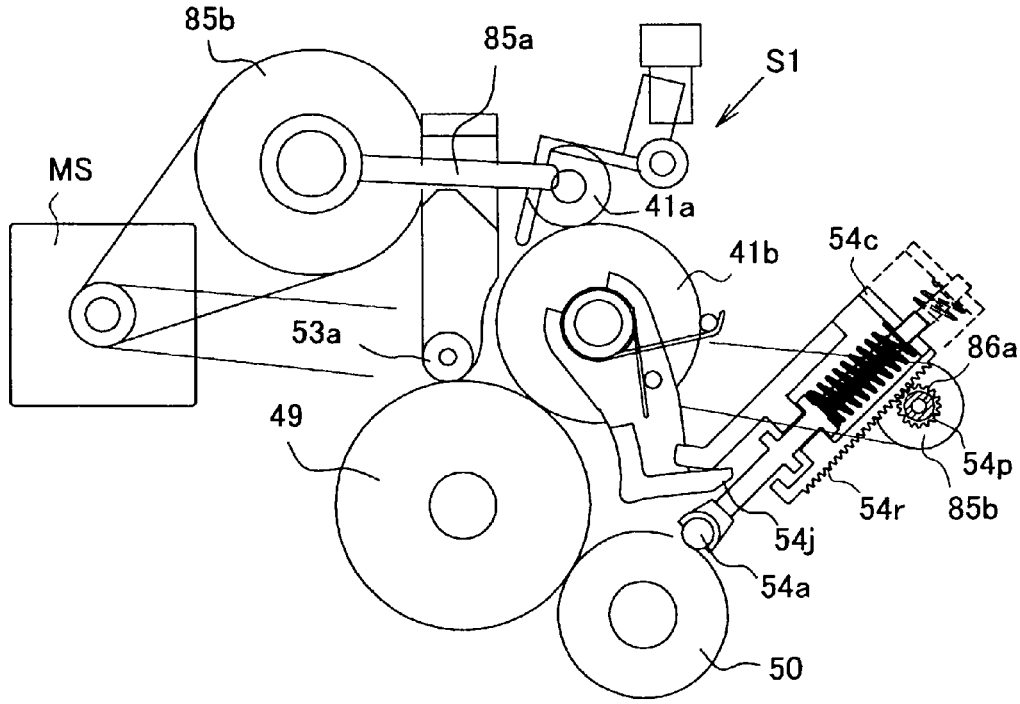

Described next is the driving mechanism of the first folding deflecting means 53 and the second folding deflecting means 54 as described previously. As shown in FIGS. 10(*a*), 10(*b*), in the first folding deflecting means 53, the driven roller 53*a* and the curved guide 53*b* are supported by the up-and-down member 53*c* moving up and down in a predetermined stroke. The up-and-down member 53*c* is provided with an actuation lever 85*a* swingable on a support shaft 85*x* as the center to engage in the member 53*c*. In other words, in the up-and-down member 53*c* supported by the apparatus frame in a guide rail (not shown) to be able to move up and down, a cam groove 53*d* is provided, and is disposed so that the front end of the actuation lever 85*a* engages in the cam groove 53*d*.

Then, the actuation lever 85*a* is coupled to the support shaft 85*x* via a spring clutch 85*d*. Concurrently therewith, the support shaft 85*x* is provided with a pulley 85*b*, and rotation of the shift motor MS is conveyed to the pulley 85*b* via a transmission belt 85*c*. Then, the spring clutch 85*d* is set to convey the rotation of the shift motor MS from the support shaft 85*x* to the actuation lever 85*a*. Concurrently therewith, when the load of predetermined torque or more is imposed, the spring clutch 85*d* idles with respect to the support shaft 85*x*, and is configured not to convey the rotation of the shift motor MS to the actuation lever 85*a*.

Accordingly, when the shift motor MS rotates in the forward direction, the actuation lever 85*a* rotates from the state of FIG. 10(*a*) to the state of FIG. 10(*b*) in a clockwise direction shown in the figure, and after the driven roller 53*a* comes into contact with the periphery of the second roller 49, the spring clutch 85*d* idles. Then, when the shift motor MS rotates in the backward direction, the actuation lever 85*a* rises from the state of FIG. 10(*b*) to the state of FIG. 10(*a*). After the up-and-down member 53*c* strikes the stopper 53*e*, the spring clutch 85*d* idles and the state is locked as shown in the figure. In addition, a limit sensor Ls is disposed in the this position, and the rotation of the shift motor MS is halted by a state signal such that the up-and-down member 53*c* shifts to a predetermined stopper position.

Meanwhile, in the second folding deflecting means 54, similarly, the up-and-down member 54*c* is supported by the apparatus frame to move up and down in a predetermined stroke, and is provided with the driven roller 54*a* and curved guide 54*b*. As described previously, the up-and-down member 54*c* is provided with the rack 54*r* that meshes with the pinion 54*p*. Then, the shift motor MS is coupled to the pinion 54*p* via a spring clutch 86*a*. The spring clutch 86*a* is set to convey the rotation of the shift motor MS within predetermined torque, while idling at the predetermined torque or more.

In addition, in the first folding deflecting means 53 and the second folding deflecting means 54, the up-and-down member 53*c* shifts in position from the withdrawal position to the actuation position by the forward-direction rotation of the shift motor MS, and by the rotation in this direction, the up-and-down member 54*c* of the second folding deflecting means shifts in position from the actuation position to the withdrawal position. Alternately, in the backward-direction rotation of the shift motor MS, the up-and-down member 54*c* of the second folding deflecting means 54 shifts in position from the withdrawal position to the actuation position, and by the rotation in this direction, the up-and-down member 53*c* of the first folding deflecting means 53 shifts in position from the actuation position to the withdrawal position. Thus, the first folding deflecting means 53 and second folding deflecting means 54 are configured to shift to positions between the actuation position and the withdrawal position in a relatively opposite manner by forward and backward direction of the shift motor MS.

[Sheet Front End Detecting Sensor]

As shown in FIG. 3, a first sensor S1 for detecting an end edge of a sheet is disposed in the first path 32, and detects the end edge (front end and rear end) of the sheet carried in the first switchback path 34. Further disposed is a second sensor S2 for detecting the end edge of the sheet carried in the second switchback path 35. The sensors S1 and S2 detect the end edge of the sheet to calculate the fold position of the sheet, and the action of the sensors will be described later together with folding forms described later.

[Folding Processing Form]

Figure 15A:
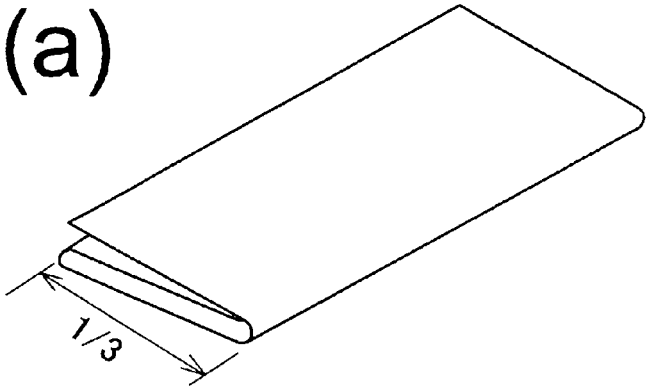
FIGS. 15(*a*)-15(*c*) contain explanatory views of sheet folding forms in the sheet folding apparatus of the invention, where FIG. 15(*a*) shows an aspect for performing inward three-folding on the sheet in a ⅓ position, FIG. 15(*b*) shows an aspect for performing Z-folding on the sheet in a ⅓ position, and FIG. 15(*c*) shows an aspect for performing Z-folding on the sheet in a ¼ position.
Figure 15B:
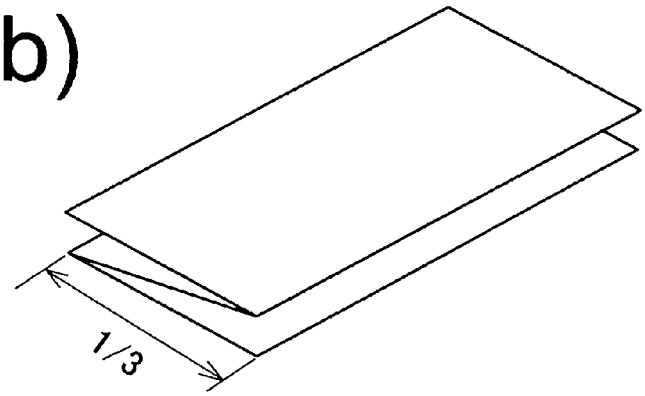
Figure 15C:
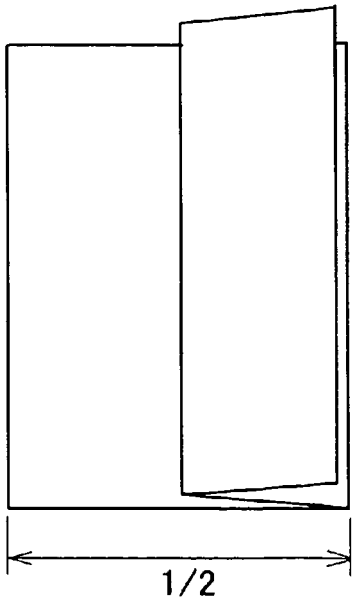

A sheet folding method by the above-mentioned folding processing means 48 will be described next according to FIGS. 15(*a*)-15(*c*). In a normal sheet with the image formed, there are cases that the sheet is folded in two or three with a binding margin left for a filing finish, and that the sheet is folded in two or three for a letter finish. Further, in folding in three, there are cases of z-folding and inward three-folding. FIG. 15(*a*) shows inward three-folding, FIG. 15(*b*) shows ⅓ Z-folding, and FIG. 15(*c*) shows ¼ Z-folding.

Then, in the case of two-folding, the sheet fed to the second path 33 is folded in a ½ position of the sheet size or in a ½ position with a binding margin left in the sheet end portion by the first and second roller 41*b*, 49 (first folding).

Meanwhile, in the case of three-folding, the sheet: fed to the second path 33 is folded in a ⅓ position of the sheet size or in a ⅓ position with a binding margin left in the sheet end portion by the first and second rollers 41*b*, 49 (first folding). The second and third rollers 49, 50 fold the remaining sheet in a ⅓ position of the folded sheet (second folding) to feed to the third path 36.

Further, in the case of three-folding, when inward three-folding is performed as shown in FIG. 15(*a*), the sheet fed to the second path 33 is folded in a ⅓ position on the sheet rear end side by the first and second rollers 41*b*, 49 and next, is folded in a ⅓ position on the sheet front end side. Similarly, in the case of ⅓ Z-folding, the sheet fed to the second path 33 is folded in a ⅓ position on the sheet front end side by the first and second rollers 41*b*, 49 and next, is folded in a ⅓ position on the sheet rear end side.

Furthermore, in the case of three-folding, when z-folding is made in a ¼ position as shown in FIG. 15(*c*), the sheet fed to the second path 33 is folded in a ¼ position on the sheet rear end side by the first and second rollers 41*b*, 49 and next, is folded in a ½ position of the sheet.

[Control Means]

The control means 95 for above-mentioned sheet folding is configured as described below. The sheet folding apparatus B as described previously is mounted with a control CPU, or a control section of the image formation apparatus A is provided with a folding processing control section. Then, the control section is configured to enable the following operation.

First, the first switchback path 34 and second switchback path 35 of the second path 33 are provided with stopper means (not shown) for regulating the position of the sheet front end or sensor means (S1 and S2 shown in the figure) for detecting the position of the sheet front end. In the apparatus as shown in the figure, the first sensor S1 is disposed in the first switchback path 34, and the second sensor S2 is disposed in the second switchback path 35. Then, the control means 95 is configured to calculate timing at which the fold position of the sheet arrives at a predetermined position from the sheet size information sent from the image formation apparatus A and a detection signal from the sensor S1 (S2).

Figure 16:
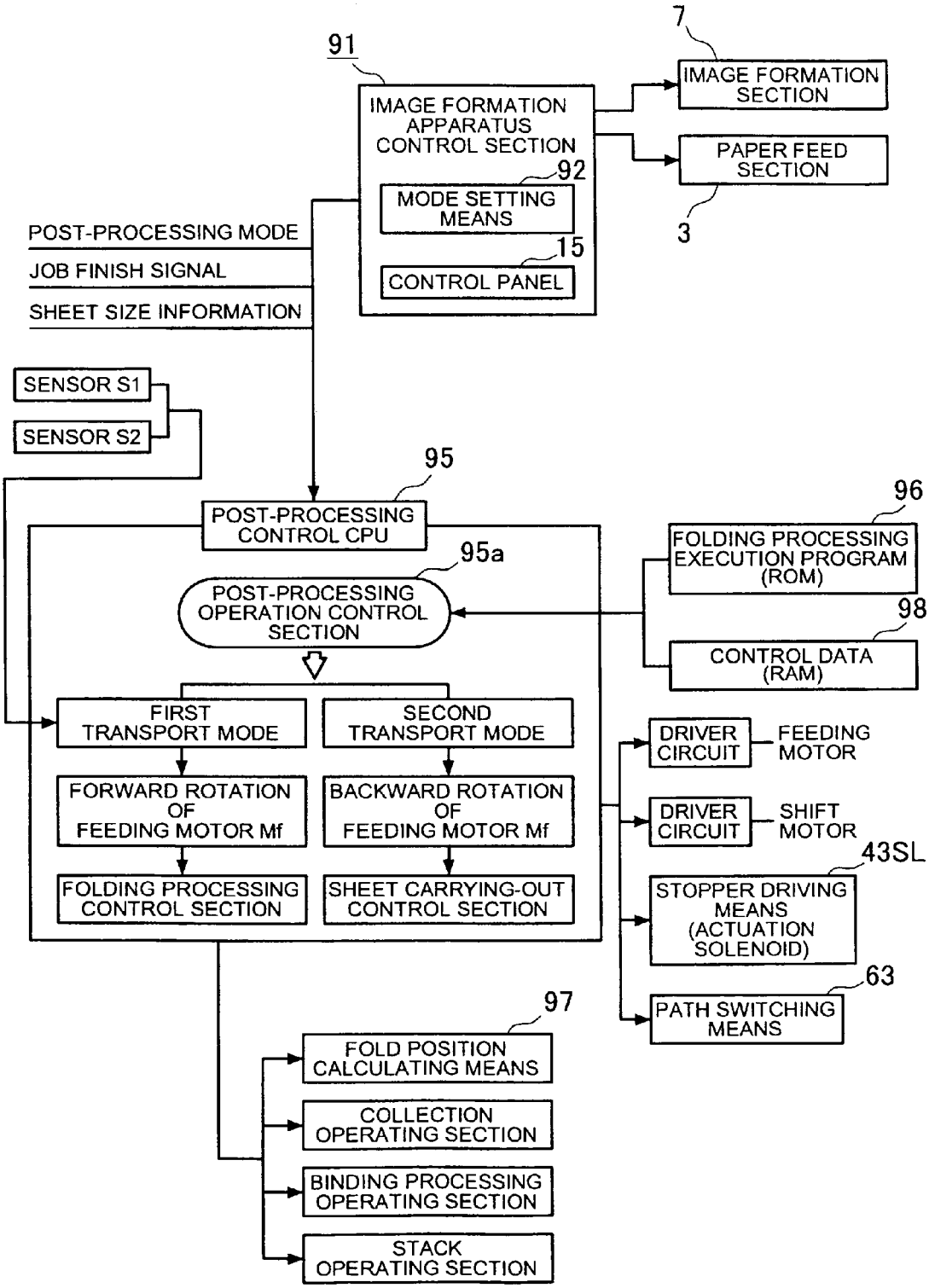
FIG. 16 is an explanatory view of a control configuration in the system of FIG. 1.

Then, the operation will be described according to the control block diagram shown in FIG. 16. The image formation apparatus A is provided with a control CPU 91, control panel 15 and mode setting means 92. The control CPU 91 controls a paper feed section 3 and image formation section 7, corresponding to image formation conditions set in the control panel 15. Then, the control CPU 91 transfers data and commands such as "post-processing mode", "job finish signal" and "sheet size information" required for post-processing to the control section 95 of the post-processing apparatus C.

The control section 95 of the post-processing apparatus C is a control CPU, and is provided with a folding processing control section 95*a*. Then, detection signals of the first sensor S1 and second sensor S2 are conveyed to the control CPU 95. Meanwhile, the control CPU 95 conveys "ON"/"OFF" control signals to the stopper driving means (solenoid 43SL) provided in the gate stopper means 43 and the path switching means 63.

Then, for the control CPU 95, folding processing execution programs are stored in ROM 96 to control the feeding motor Mf, shift motor MS, stopper driving means (solenoid 43SL) and path switching means 63 so as to execute the folding forms as described previously. Further, RAM 98 stores data to calculate the fold of the sheet in fold position calculating means 97, and actuation timing time of the shift motor Ms as data.

The fold position calculating means 97 is comprised of a computing circuit for calculating a fold position (dimension) from the sheet front end (front end in the sheet discharge direction), from the "sheet length size", "folding form" and "binding margin dimension". For example, in the two-folding mode, the sheet is folded in a ½ position in the sheet discharge direction, or a ½ position with a beforehand set binding margin left. For example, calculation of the fold position is obtained by calculating [{(sheet length size)−(binding margin)}/2].

Further, in the three-folding mode, for example, the fold position is calculated corresponding to the folding form such as letter folding (inward three-folding, ⅓ Z-folding) and filing folding (¼ Z-folding, ⅓ Z-folding).

[Folding Processing Operation]

Figure 12A:
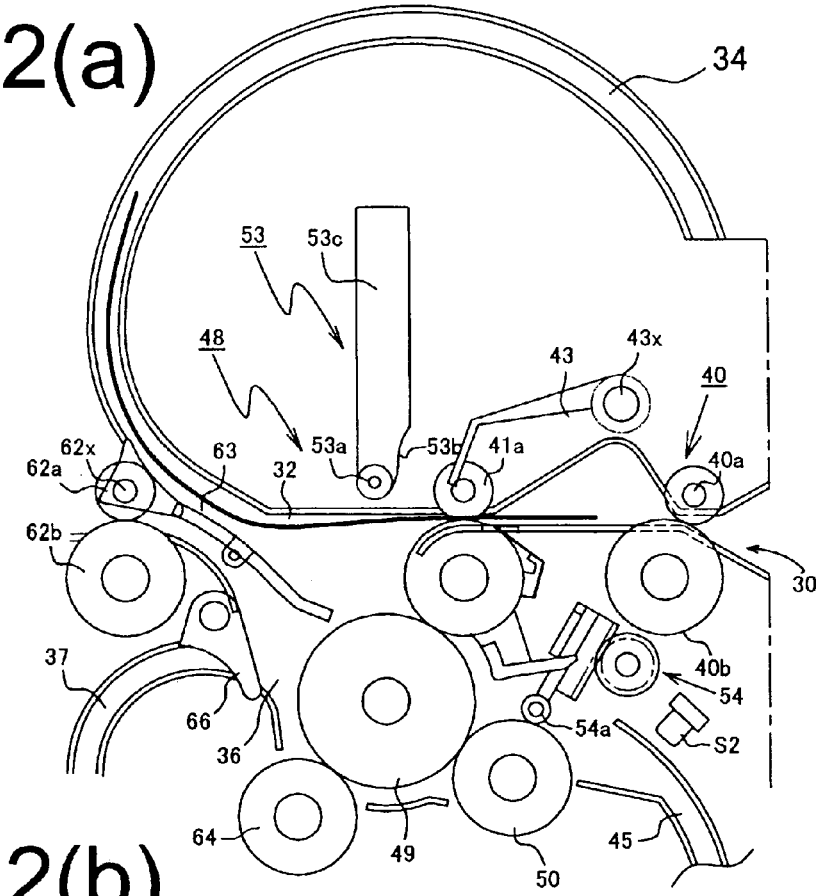
FIGS. 12(*a*), 12(*b*) contain explanatory views of the operating state of the apparatus of FIG. 3, where FIG. 12(*a*) shows a state in which a sheet is carried from a first path to a second path, and FIG. 12(*b*) shows a state in which a fold position of the sheet is inserted in a first nip portion.
Figure 12B:
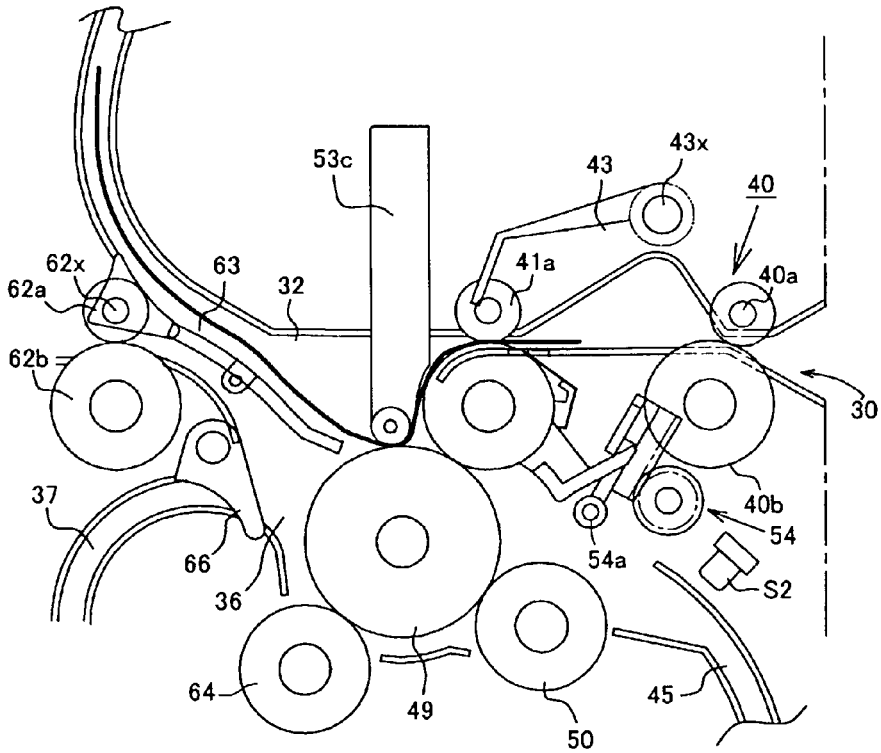

The action in the configuration of the sheet folding apparatus B will be described. FIG. 11(*b*) shows a state in which a sheet entering the carry-in entrance 30 undergoes register correction, and FIG. 12(*a*) shows a state in which the sheet is carried in the first switchback path 34 for first folding. FIG. 12(*b*) shows a state in which the sheet is folded in the first folding position Np1, FIG. 13(*a*) shows a state in which the folded sheet is carried in the second switchback path 35, FIG. 13(*b*) shows a state in which the sheet is folded in the second folding position Np2, and FIG. 14(*a*) is a state in which the folded sheet is carried out.

In FIG. 11(*b*), a sheet is guided to the carry-in entrance 30, and fed to the downstream side by the carry-in roller pair (first transport means) 40. At this point, the control means 95*a* controls the stopper driving mechanism so that the gate stopper means 43 is positioned in the lock position Ps. Then, the sheet front end is locked by the lock surface 43*s* of the stopper member, and the sheet is curved and deformed in the shape of a loop inside the register area, and at this point, aligned in the front end according to the lock surface 43*s*. Next, the control means 95 retracts the gate stopper means 43 from the lock position Ps to the waiting position Pw.

In FIG. 12(*a*), the control means 95 shifts the gate stopper means 43 from the lock position Ps to the waiting position Pw. Then, the sheet is fed to the downstream side in the first path 32 by the above-mentioned sheet transport mechanism. Then, the control means 95 controls the path switching means 63 so as to guide the sheet to the first switchback path 34 from the first path 32 as shown in FIG. 12(*a*).

Thus, the sheet is carried in the first switchback path 34 by the pinch roller Ola and the first roller 41*b*. In addition, in the first path 32, the first sensor S1 is disposed on the downstream side of the pinch roller 41*a* and the first roller 41*b*, and detects the sheet front end carried in the first switchback path 34.

In FIG. 12(*b*), based on a signal such that the first sensor S1 detects the sheet front end, the control means 95 shifts the up-and-down member 53*c* of the first folding deflecting means 53 from the waiting position to the actuation position at timing at which the fold position of the sheet is shifted to a predetermined position. Thus, the sheet in the first path 32 is deformed in the shape of a V toward the first nip portion Np1. Then, when the driven roller 53*a* attached to the up-and-down member 53*c* comes into press-contact with the periphery of the second roller 49, the sheet front end side is fed in the opposite direction (rotation direction of the second roller).

Meanwhile, the sheet rear end side feeds the sheet toward the first nip portion Np1 by transport force of the pinch roller 41*a* and the first roller 41*b*. At this point, the curved guide surface of the curved guide 53*b* regulates the sheet to follow the roller periphery of the first roller 41*b*.

Accordingly, the sheet is fed toward the first folding position Np1 on the front end side by the driven roller 53*a* and on the rear end side by the pinch roller 41*a* and the first roller 41*b*, and up-and-down timing of the up-and-down member 53*c* is to calculate the fold position. Therefore, the control means 95 beforehand sets the velocity for shifting the sheet by the pinch roller 41*a* and the first roller 41*b* and the timing (particularly, timing at which the driven roller 53*c* comes into contact with the periphery of the second roller 49) for shifting the driven roller 53*a* to the actuation position from the waiting position at optimal values by experiments.

Then, the curved guide surface of the curved guide 53*b* guides the sheet to follow the periphery of the opposed first roller 41*b* in synchronization with the shift of the driven roller 53*a* from the waiting position to the actuation position, and therefore, there is no fear that the fold position of the sheet changes every time.

Figure 13A:
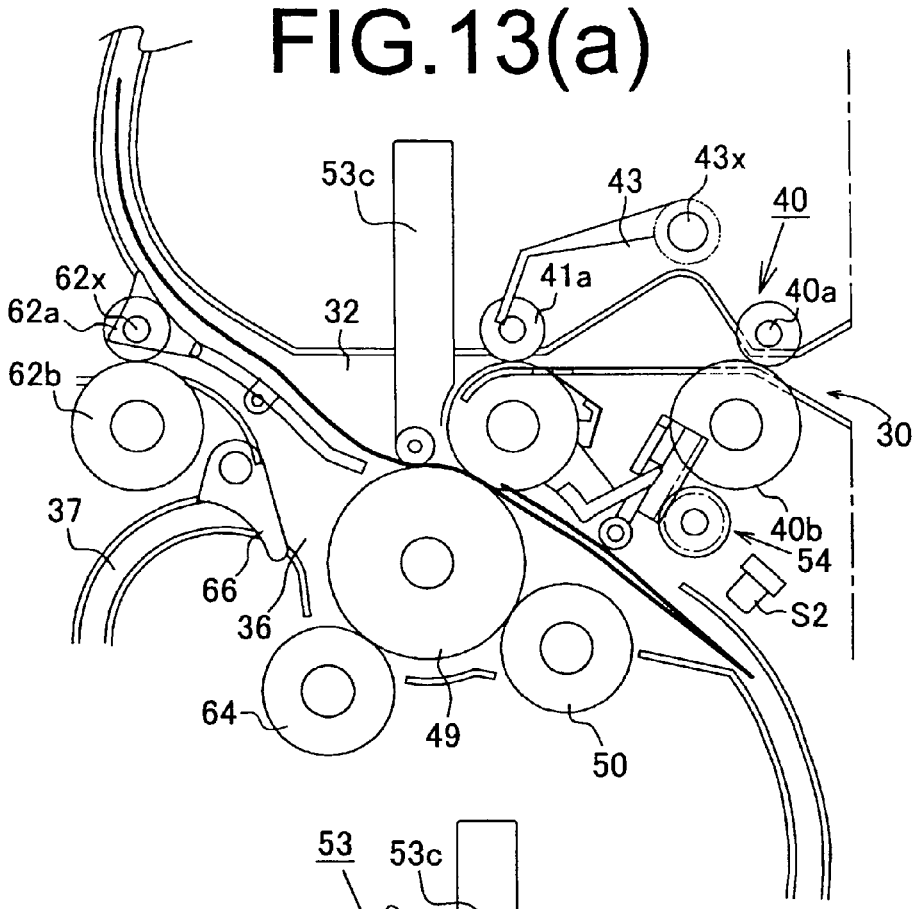
FIGS. 13(*a*), 13(*b*) contain explanatory views of the operating state of the apparatus of FIG. 3, where FIG. 13(*a*) shows a state in which the first-folded sheet is fed to a second switchback path, and FIG. 13(*b*) shows an initial state in which the sheet undergoes second folding in a second nip portion.
Figure 13B:
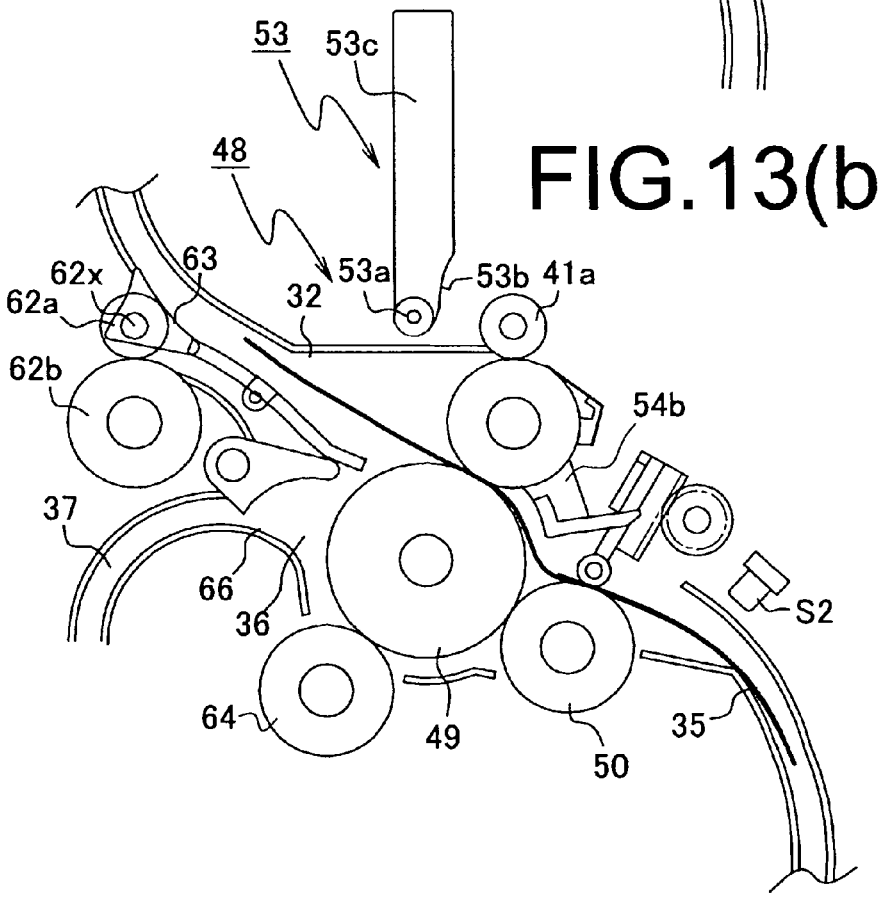

In FIG. 13(*a*), the sheet folded in the ½ position (two-folding), ⅓ position (three-folding) or ¼ position (three-folding) in the first nip portion Np1 is provided with the transport force by the first nip portion Np1 and fed to the downstream side. Then, the control means 95 positions the up-and-down member 54*c* of the second folding deflecting means 54 in the actuation position in the two-folding mode, or in the waiting position in the three-folding mode. FIG. 13(*a*) shows control of the three-folding mode. In two-folding, the up-and-down member 54*c* is positioned in the actuation position, and the folded sheet is guided to the second nip portion Np2 beginning with the front end, and is fed to the carrying-out exit 31 on the downstream side.

Then, in the three-folding mode, the control means 95 positions the up-and-down member 54*c* of the second folding deflecting means 54 in the waiting position as shown in FIG. 13(*a*). Thus, the sheet fed from the first nip portion Np1 is fed to the second switchback path 35 beginning with the front end. Then, the second sensor S2 detects the sheet front end (fold position).

In FIG. 13(*b*), with reference to a detection signal of the second sensor S2, in a stage in which the fold position for second folding arrives at a predetermined position, the control means 95 shifts the up-and-down member 54*c* of the second folding deflecting means 54 from the waiting position to the actuation position. Then, the sheet inside the second switchback path 35 is fed in the opposite direction in a stage in which the driven roller 54*a* comes into contact with the periphery of the third roller 50.

By this means, the sheet is guided to the second nip portion Np2 by the front end side sending the sheet by the driven roller 54*a* and the rear end side sending the sheet by the first nip portion Np1 in respective opposite directions. In addition, in this case, the shift Liming of the up-and-down member 54*c* from the waiting position to the actuation position is the same as in the case of the first folding deflecting means 53 as described previously, and the action of the guide member 54*b* is also the same as in the case.

Figure 14:
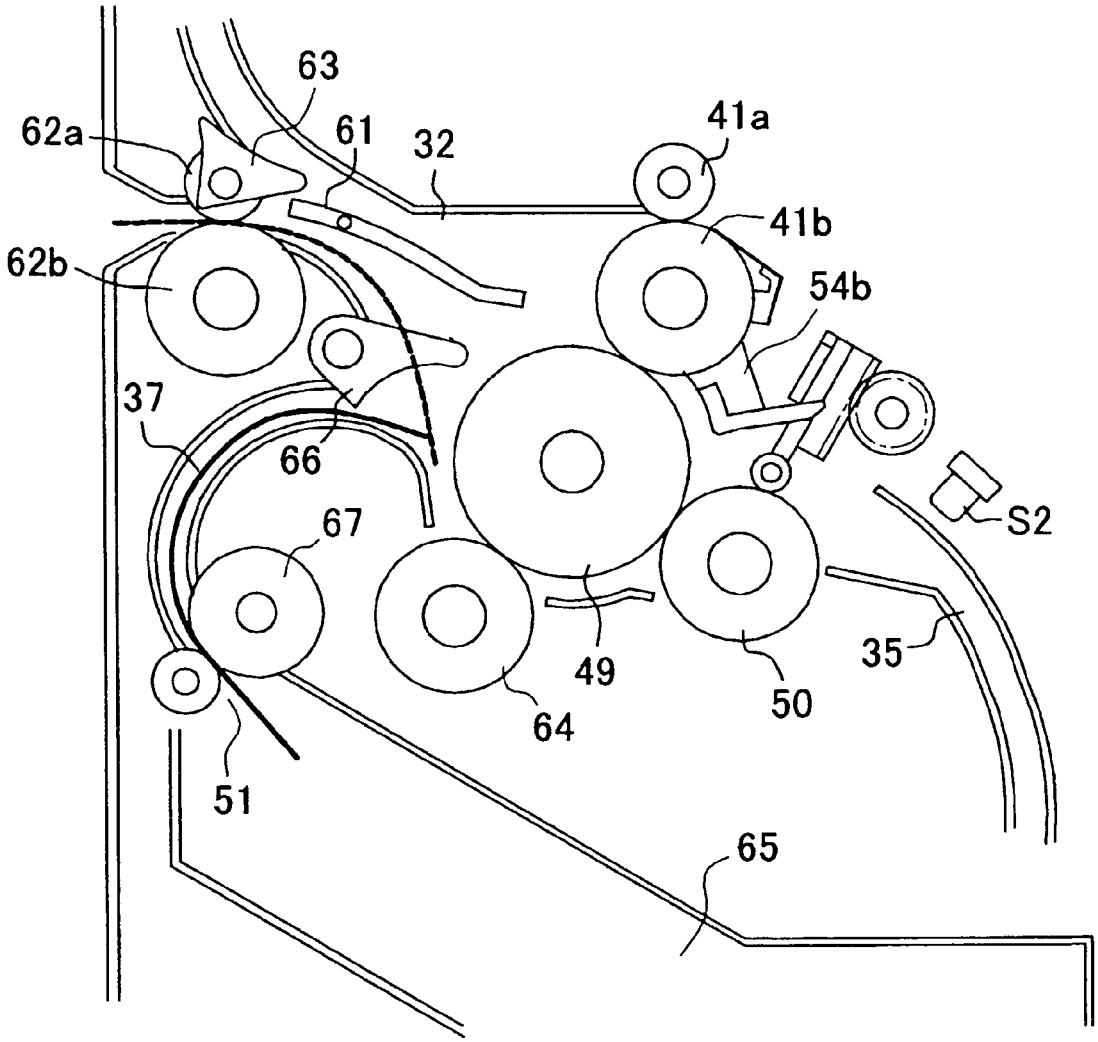
FIG. 14 is a state explanatory view of sheet folding operation and shows a state in which the sheet that is folded in the second nip portion is fed in a sheet discharge direction.

In FIG. 14, in the folded sheet fed to the second folding position (second nip portion) Np2, the fold is reliably folded by the folding enhancement roller 64 coming into press-contact with the second roller 49, and the sheet is carried to the third path 36. Then, the control means 95 feeds the folded sheet to the sheet discharge path 37 or feeds the sheet back to the first path 32 corresponding to the beforehand set sorting form. In the apparatus as shown in the figure, in inward three-folding and ⅓ Z-folding of the letter folding form with no need of binding in the post-processing apparatus C, the control means 95 controls a path switching flapper 66 to guide the sheet from the sheet discharge path 37 to the storage stacker 65.

Further, in the two-folding mode and three-folding mode of ¼ Z-folding or the like for filing or with the need of the post-processing such as bookbinding processing, the sheet is carried to the first path 32 from the third path 36, and fed to the post-processing apparatus C from the carrying-out exit 31.

[Folding Operation in the Two-Folding Mode]

Figure 17A:
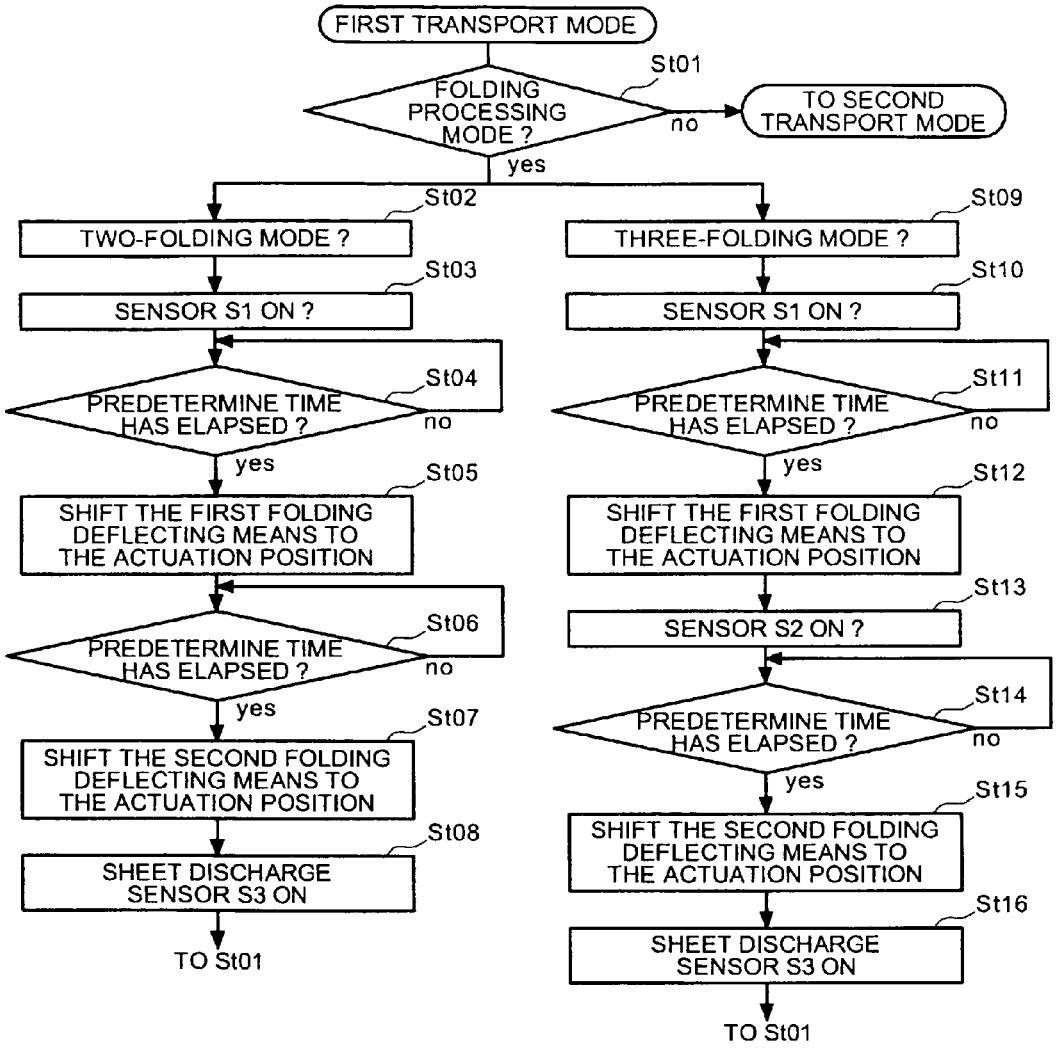
FIGS. 17(*a*), 17(*b*) are flowcharts illustrating processing operation in the control configuration of FIG. 16.
Figure 17B:
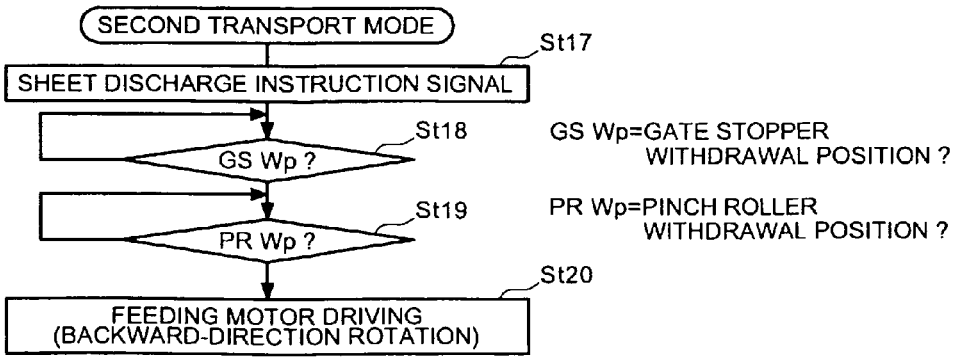

In the above-mentioned folding operation, in the mode for folding the sheet in two, as shown in FIG. 17(*a*), the control means 95 receives a mode instruction signal of whether or not to perform folding processing concurrently with a sheet discharge instruction signal from the image formation apparatus A. Next, the control means 95 calculates the fold position in the fold position calculating means 97 (St01). Then, in the two-folding mode (St02), the first sensor S1 detects the sheet front end (St03). After a lapse of sheet feeding time corresponding to the sheet length calculated in the fold position calculating means 97 from the detection signal (St04), the control means 95 shifts the first folding deflecting means 53 from the waiting position to the actuation position (St05). This shift is controlled by rotation of the shift motor MS.

In the process during which the up-and-down member 53*c* of the first folding deflecting means 53 shifts to the actuation position, as described in FIG. 12(*b*), the sheet in the first path 32 is distorted toward the first nip portion Np1 with reference to the fold position. Then, when the driven roller 53*a* of the first folding deflecting means 53 comes into contact with the periphery of the second roller 49, the sheet is drawn and inserted in the first nip portion Np1 beginning with the fold position.

At this point, in the two-folding mode, after a lapse of predicted time that the fold of the sheet is inserted in the first nip portion Np1 with reference to a detection signal from the first sensor S1 (St06), the control means 95 shifts the second folding deflecting means 54 to the actuation position (St07). The predicted time is set at time elapsed before the front end of the folded sheet arrives at the curved guide 54*b* after the fold position of the sheet is inserted in the first nip portion Np1. Accordingly, the front end of the folded sheet is guided by the curved guide surface of the curved guide 54*b* and is brought along the second roller periphery in the state as shown in FIG. 13(*b*).

Concurrently therewith, since the driven roller 54*a* positioned in the actuation position rotates according to rotation of the third roller 50, even when the front end of the folded sheet is curled in the direction departing from the second nip portion Np2, the sheet is reliably guided to the second nip portion Np2 by the rotation of the driven roller 54*a* and third roller 50.

Then, the control means 95 carries the folded sheet, which is fed from the second nip portion Np2 to the third path 36, to the first path 32 from the third path 36. Next, the control means 95 prepares for processing of a subsequent sheet in a state in which the second folding deflecting means 54 is positioned in the actuation position (St08). In the apparatus as shown in the figure, in relation to the first folding deflecting means 53 positioned in the waiting position, the second folding deflecting means 54 shifting to positions in a relatively opposite manner is positioned in the actuation position, but it is also possible to configure so that the second folding deflecting means 54 shifts to the waiting position by a detection signal of a sheet discharge sensor S3 disposed in the third path 36.

[Folding Operation of the Three-Folding Mode]

In the mode for folding the sheet in three, as described in FIGS. 12(*a*) to 14, the control means 95 receives a mode instruction signal of whether or not to perform folding processing concurrently with a sheet discharge instruction signal from the image formation apparatus A. Next, the control means 95 calculates the fold position in the fold position calculating means 97 (St01). Then, in the three-folding mode (St09), the first sensor S1 detects the sheet front end (St10).

After a lapse of sheet feeding time corresponding to the sheet length calculated in the fold position calculating means 97 from the detection signal (St11), the control means 95 shifts the first folding deflecting means 53 from the waiting position to the actuation position (St12). This shift is controlled by rotation of the shift motor MS.

In the process during which the up-and-down member 53*c* of the first folding deflecting means 53 shifts to the actuation position, as described in FIG. 12(*b*), the sheet in the first path 32 is distorted toward the first nip portion Np1 with reference to the fold position. Then, when the driven roller 53*a* of the first folding deflecting means 53 comes into contact with the periphery of the second roller 49, the sheet is drawn and inserted in the first nip portion Np1 beginning with the fold position. At this point, in the three-folding mode, the control means 95 waits for the second sensor S2 to detect the sheet front end (St13).

After a lapse of predicted time that the second-folding fold position of the sheet arrives at a predetermined position with reference to a detection signal such that the second sensor S2 detects the sheet front end (St14), the control means 95 shifts the second folding deflecting means 54 to the actuation position (St15). The predicted time is set at a calculation value of the fold position calculating means 97. Then, the sheet is given the transport force from the driven roller 54*a* and is inserted in the second nip portion Np2. The sheet discharge sensor S3 detects the sheet front end, and the sheet is carried out to the first path 32 from the third path 36, or carried out to the storage stacker 65 from the sheet discharge path 37 corresponding to the folding form (St16).

In addition, when the post-processing mode (second transport mode) without performing the sheet folding processing is set from the mode setting means 92 in the above-mentioned step St01 (St17), as shown in FIG. 11(*a*), the gate stopper 43 and the pinch roller 41*a* are shifted to the withdrawal positions outside the path (St18, St19), and concurrently, the guide cover 44 is shifted to the position for covering the periphery of the first roller 41*b*. At this point, the sheet guide 61 is positioned in the state (first guide attitude) of FIG. 11(*a*).

Then, when the feeding motor Mf is rotated backward (St20), the sheet sent to the carry-in entrance 30 is fed toward the register area Ar by the carry-in roller pair 40. This sheet is fed upward in the register area Ar, and sent toward the carrying-our roller pair 62. Then, in the first path 32, the sheet guide 61 feeds the sheet front end into the nip point of the carrying-out roller pair 62. Accordingly, the sheet is guided to the carrying-out exit (carrying-out portion) 31 smoothly without undergoing stress of the gate stopper 43, pinch roller 41*a* and first roller 41*b*.

[Configuration of the Sheet Discharge Path]

The folded sheet that is folded in two or three as described above is fed to the third path 36 from the press-contact point of the second and third rollers 49, 50. Then, the sheet is further folded by the folding enhancement roller 64 in press-contact with the second roller 49, and guided to the third path 36. The third path 36 merges with the first path 32 as described previously. The sheet discharge path 37 branches off from the third path 36, is provided via the path switching flapper 66, and guides the folded sheet to the storage stacker 65 disposed below the second path 33. The sheet discharge path has the curvature R3 and is configured as described previously. Reference "67" shown in the figure denotes the sheet discharge roller disposed in the sheet discharge path 37.

Accordingly, the sheet with no need of carrying to the post-processing apparatus C e.g. the sheet folded in the letter form such as inward three-folding and ⅓ Z-folding is stored in the storage stacker 65 without being carried to the carrying-out exit 31.

Then, in the folded sheet fed to the third path 36, the sheet to feed to the post-processing apparatus C for post-processing is carried toward the carrying-out exit 31 by the carrying-out roller 62. In addition, in this case, determination whether or not to perform post-processing is configured to be made by setting the post-processing condition concurrently with the image formation conditions in the control panel 15. Then, it is configured that the sheet is carried out to the storage stacker 65 or carried to the post-processing apparatus C corresponding to the set finish condition.

[Image Formation Apparatus]

The image formation apparatus A is provided with the following configuration as shown in FIG. 1. In this apparatus, the paper feed section 3 feeds a sheet to the image formation section 7, the image formation section 7 prints in the sheet, and the sheet is carried out of the main-body sheet discharge outlet 18. The paper feed section 3 stores sheets of a plurality of sizes in paper cassettes 4*a*, 4*b*, and separates designated sheets on a sheet-by-sheet basis to feed to the image formation section 7. In the image formation section 7, for example, an electrostatic drum 8, and a printing head (laser emitting device) 9, developing device 10, transfer charger 11 and fuser 12 arranged around the drum 8 are disposed, the laser emitting device 9 forms an electrostatic latent image on the electrostatic drum 8, the developing device 10 adds toner to the image, the transfer charger 11 transfers the image onto the sheet, and the fuser 12 heats and fuses the image.

The sheet with the image thus formed is sequentially carried out of the main-body sheet discharge outlet 18. Reference "13" shown in the figure denotes a circulating path, and is a path for two-side printing for reversing the side of the sheet printed on the front side from the fuser 12 via a main-body switchback path 14, then feeding the sheet to the image formation section 7 again, and printing on the backside of the sheet. Thus two-side printed sheet is carried out of the main-body sheet discharge outlet 18 after the side of the sheet is reversed by the main-body switchback path 14.

Reference "20" shown in the figure denotes an image reading section, scans an original document sheet set on a platen 21 with a scan unit 22, and electrically reads the sheet with a photoelectric conversion element not shown. For example, the image data is subjected to digital processing in an image processing section, and then, transferred to a data storing section 16, and an image signal is sent to the laser emitting device 9. Further, reference "25" shown in the figure denotes a feeder apparatus, and feeds original document sheets stored in a stacker 26 to the platen 21.

The image formation apparatus A with the above-mentioned configuration is provided with a control section (controller) not shown, and image formation conditions such as, for example, sheet size designation and color/monochrome printing designation and printout conditions such as number-of-copy designation, one-side/two-side printing designation, and scaling printing designation are set from the control panel 15.

Meanwhile, the image formation apparatus A is configured so that image data read by the scan unit 22 or image data transferred from an external network is stored in the data storing section 16, the data storing section 16 transfers the image data to buffer memory 17, and that the buffer memory 17 transfers a data signal to the printing head 9 sequentially.

Concurrently with the image formation conditions, a post-processing condition is also input and designated from the control pane 115. As the post-processing condition, for example, selected is a "printout mode", "staple binding mode", "sheet-bunch folding mode" or the like. The post-processing condition is set for the folding form in the sheet folding apparatus B as described previously.

[Post-Processing Apparatus]

Figure 2:
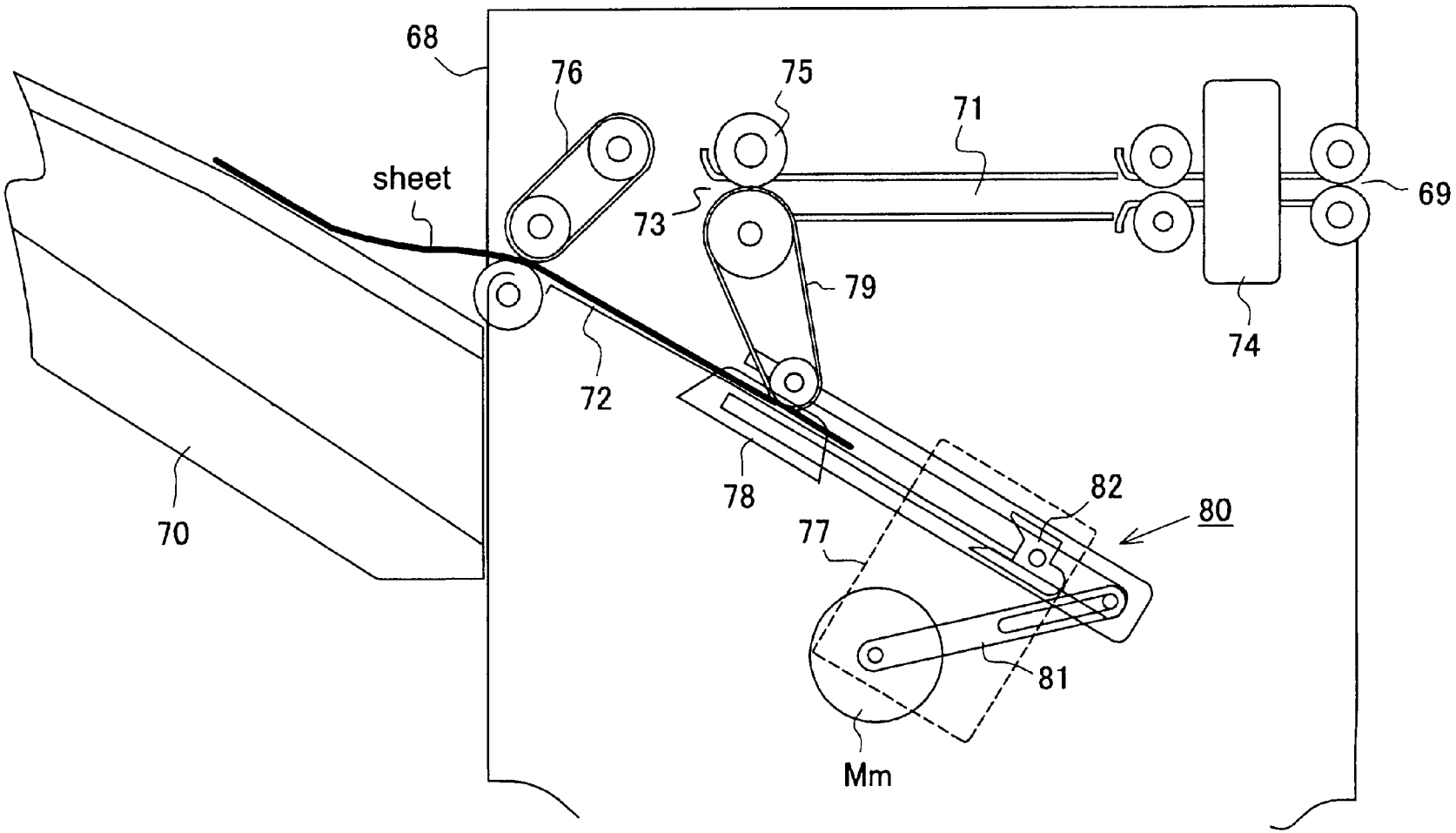
FIG. 2 is an enlarged explanatory view of principal part of a post-processing apparatus in the system of FIG. 1.

As shown in FIG. 2, the post-processing apparatus C is provided with the following configuration. This apparatus has a housing 68 provided with the sheet receiving opening 69, sheet discharge stacker 70, and post-processing path 71. The sheet receiving opening 69 is coupled to the carrying-out exit 31 of the sheet folding apparatus B as described previously, and is configured to receive a sheet from the first transport path 32 or the third transport path 36.

The post-processing path 71 is configured to guide the sheet from the sheet receiving opening 69 to the sheet discharge stacker 70, and a processing tray 72 is provided in the path. Reference "73" shown in the figure denotes a sheet discharge outlet, and is to collect sheets from the post-processing path 71 in the processing tray 72 disposed on the downstream side. Reference "74" shown in the figure denotes a punch unit, and is disposed in the post-processing path 71. A sheet discharge roller 75 is disposed in the sheet discharge outlet 73 to collect a sheet from the sheet receiving opening 69 in the processing tray 72.

On the processing tray 72, sheets from the post-processing path 71 are switch-back transported (in the direction opposite to the transport direction), and collated and collected using a rear end regulating member (not shown) provided on the tray. Therefore, above the tray is provided a forward/backward rotation roller 75 for switching back the sheet from the sheet discharge outlet 73. Further, the processing tray 72 continues to the sheet discharge stacker 70, and the sheet from the sheet discharge outlet 73 is supported (bridge-supported) on the front end side by the sheet discharge stacker 70 and on the rear end side by the processing tray 72.

On the processing tray 72 is disposed a stapler unit 77 for binding a sheet bunch positioned by the rear end regulating member. Reference "78" shown in the figure denotes aligning means, and aligns the width of the sheet carried onto the processing tray in the direction orthogonal to the transport direction. Reference "79" shown in the figure denotes a paddle rotating body, and is coupled to a rotary shaft of the sheet discharge roller 75 to be driven to carry the sheet from the sheet discharge roller 75 toward the rear end regulating member.

Reference "80" shown in the figure denotes sheet bunch carrying-out means, and carries a sheet bunch bound by the stapler unit 77 to the sheet discharge stacker 70 on the downstream side. Therefore, the sheet bunch carrying-out means 80 shown in the figure is comprised of a lever member 81 axially supported at the base end portion to be swingable, and a sheet end engagement member 82.

Then, the sheet end engagement member 82 is equipped in the processing tray to reciprocate in the sheet discharge direction along the processing tray 72, and is coupled to the lever member 81. Reference "Mm" shown in the figure denotes a driving motor for causing the lever member 81 to perform swinging motion. In addition, the sheet discharge stacker 70 is provided with an elevator mechanism, not shown, which moves up and down corresponding to a load amount of sheets.

What is claimed is:

1. A sheet folding apparatus for performing folding processing on a sheet from a carry-in portion and transferring the sheet to a carrying-out portion, comprising:

a first transport path for guiding the sheet from the carry-in portion to the carrying-out portion without performing the folding processing;

a second transport path branching off from the first transport path and disposed to cross the first transport path, for performing the folding processing on the sheet from the carry-in portion and guiding the sheet to the carrying-out portion;

a carry-in roller disposed in the carry-in portion of the first transport path;

a carrying-out roller disposed in the carrying-out portion of the first transport path;

folding rollers disposed in folding positions of the second transport path to fold the sheet;

a driving motor for driving the carry-in roller, the carrying-out roller, and the folding rollers; and control means for controlling the driving motor, wherein one of the folding rollers is disposed so that at least part of a periphery faces the first transport path in between the carry-in roller and the carrying-out roller, the first transport path is provided with a pinch roller capable of coming into press-contact with and separating from the periphery of the one of the folding rollers, and a guide cover for covering the periphery of the one of the folding rollers facing the first transport path, the guide cover is configured to be able to shift to positions between an actuation position for covering so that the sheet that is carried in the first transport path does not contact the periphery of the one of the folding rollers and a non-actuation position in which the sheet engages with the periphery of the one of the folding rollers, and the control means controls the guide cover to shift to the actuation position with the pinch roller separated from the periphery of the one of the rollers.

2. The sheet folding apparatus according to claim 1, further comprising path switching means disposed between the first transport path and the second transport path, wherein the control means controls the path switching means to constitute a first transport mode for carrying the sheet from the carry-in portion to the second transport path, and a second transport mode for carrying the sheet to the carrying-out portion without carrying the sheet to the second transport path, and controls roller moving up/down means and guide shift means so as to separate the pinch roller from the periphery of the one of the folding rollers while shifting the guide cover to the actuation position with the one of the folding rollers stopped in the second transport mode.

3. The sheet folding apparatus according to claim 1, wherein the driving motor comprises a single motor configured to drive and rotate the carry-in roller, the carrying-out roller, and the folding rollers in a predetermined direction by rotating the motor in one direction, and to drive and rotate the carry-in roller and the carrying-out roller in a predetermined direction by rotating the motor in an opposite direction with the folding rollers stopped.

4. The sheet folding apparatus according to claim 1, wherein the second transport path includes a path end portion positioned on an upstream side of the folding positions, and a path end portion positioned on a downstream side of the folding positions, and the path end portion on the upstream side and the path end portion on the downstream side are disposed vertically in areas to face each other, and sandwiching the first transport path.

5. The sheet folding apparatus according to claim 4, wherein a path for guiding the sheet to the folding positions in the second transport path, comprises a curved path branching off from the first transport path, the sheet transferred to the curved path being reversed in a transport direction to be transferred the folding positions.

6. The sheet folding apparatus according to claim 1, wherein the folding rollers comprise of a first folding roller pair for performing first folding on the sheet from the carry-in portion and a second roller pair for performing second folding on the sheet subjected to the first folding, and the first folding roller pair is disposed so that at least part of the periphery faces the first transport path in between the carry-in roller and the carrying-out roller.

7. The sheet folding apparatus according to claim 1, further comprising an image forming section for forming an image on the sheet, disposed on an upstream side of the carry-in portion, and a sheet storing section for loading and holding the sheet disposed on a downstream side of the carrying-out portion.

* * * * *